US009633492B2

(12) United States Patent
Panko

(10) Patent No.: US 9,633,492 B2
(45) Date of Patent: Apr. 25, 2017

(54) SYSTEM AND METHOD FOR A VEHICLE SCANNER TO AUTOMATICALLY EXECUTE A TEST SUITE FROM A STORAGE CARD

(75) Inventor: James A. Panko, Wonder Lake, IL (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 13/198,426

(22) Filed: Aug. 4, 2011

(65) Prior Publication Data

US 2012/0046826 A1 Feb. 23, 2012

Related U.S. Application Data

(60) Provisional application No. 61/374,930, filed on Aug. 18, 2010.

(51) Int. Cl.
*G07C 5/08* (2006.01)

(52) U.S. Cl.
CPC ..... *G07C 5/0883* (2013.01); *G07C 5/0808* (2013.01); *G07C 5/0858* (2013.01); *G07C 2205/02* (2013.01)

(58) Field of Classification Search
CPC G07C 5/0808; G07C 2205/02; G07C 5/0816; G07C 5/085; G07C 5/0858; G07C 5/0875; G07C 5/0883
USPC ..... 701/33, 33.2, 33.3
See application file for complete search history.

(56) References Cited

U.S. PATENT DOCUMENTS

| | | | |
|---|---|---|---|
| 2,587,079 | A | 2/1952 | Woods et al. |
| 2,680,210 | A | 6/1954 | Miller et al. |
| 4,058,826 | A | 11/1977 | Schneider |
| 4,072,851 | A | 2/1978 | Rose |
| 4,104,725 | A | 8/1978 | Rose et al. |

(Continued)

FOREIGN PATENT DOCUMENTS

| | | | |
|---|---|---|---|
| CA | 2373157 | A1 | 3/2000 |
| DE | 19543784 | A1 | 5/1997 |

(Continued)

OTHER PUBLICATIONS

European Patent Office, International Search Report for International Application No. PCT/US2011/047323, Nov. 7, 2011.

(Continued)

*Primary Examiner* — Basil T Jos
(74) *Attorney, Agent, or Firm* — McDonnell Boehnen Hulbert & Berghoff LLP

(57) ABSTRACT

Disclosed are systems and methods for a vehicle scanner to automatically execute applications from a removable storage card. The method includes detecting a presence of one or more executable diagnostic requests in removable data storage, and responsive to the detection, transmitting one or more corresponding requests for vehicle diagnostic data to the vehicle via a vehicle interface. Responsive to the transmission, the vehicle scanner receives and processes diagnostic data from the vehicle. The vehicle scanner may store the data back to the removable storage card, or may transmit the data via a wired or wireless interface to a display device. As part of the detection process, the vehicle scanner may first authenticate the removable storage card before executing vehicle diagnostic instructions from the card.

19 Claims, 15 Drawing Sheets

(56) References Cited

U.S. PATENT DOCUMENTS 4,113,980 A 9/1978 Bell
4,257,104 A 3/1981 Martin et al.
4,270,174 A 5/1981 Karlin et al.
4,404,639 A 9/1983 McQuire et al.
4,441,359 A 4/1984 Ezoe
4,602,127 A 7/1986 Neely et al.
4,774,438 A 9/1988 Rogers et al.
4,814,896 A 3/1989 Heitzman et al.
4,853,850 A 8/1989 Krass, Jr. et al.
4,962,456 A 10/1990 Abe et al.
5,157,610 A 10/1992 Asano et al.
5,160,892 A 11/1992 Makhija et al.
5,317,304 A 5/1994 Choi
5,365,436 A 11/1994 Schaller et al.
5,373,458 A 12/1994 Bishay et al.
5,396,168 A 3/1995 Heep et al.
5,417,222 A 5/1995 Dempsey et al.
5,432,904 A 7/1995 Wong
5,442,553 A 8/1995 Parrillo
5,465,207 A 11/1995 Boatwright et al.
5,506,772 A 4/1996 Kubozono et al.
5,507,288 A 4/1996 Bocker et al.
5,521,443 A 5/1996 Imura et al.
5,532,927 A 7/1996 Pink et al.
5,541,840 A 7/1996 Gurne et al.
5,583,912 A 12/1996 Schillaci et al.
5,592,383 A 1/1997 Rogers et al.
5,687,717 A 11/1997 Halpern et al.
5,758,300 A 5/1998 Abe
5,766,020 A 6/1998 Hughes
5,836,666 A 11/1998 Aoyama et al.
5,850,209 A 12/1998 Lemke et al.
5,884,202 A 3/1999 Arjomand
5,899,947 A 5/1999 Hall et al.
5,923,161 A 7/1999 Frankovitch, Jr. et al.
6,021,366 A 2/2000 Fieramosca et al.
6,055,468 A 4/2000 Kaman et al.
6,067,486 A 5/2000 Aragones et al.
6,094,609 A 7/2000 Arjomand
6,134,489 A 10/2000 Smedley
6,140,811 A 10/2000 Little
6,169,943 B1 1/2001 Simon et al.
6,178,527 B1 1/2001 Vidales
6,179,214 B1 1/2001 Key et al.
6,181,563 B1 1/2001 Shimbo et al.
6,181,992 B1 * 1/2001 Gurne ..... B60T 8/885 701/31.4
6,188,384 B1 2/2001 Sullivan et al.
6,192,303 B1 2/2001 Takakura et al.
6,195,617 B1 2/2001 Miller
6,222,374 B1 4/2001 Shoemaker
6,294,982 B1 9/2001 Hooks et al.
6,311,138 B2 10/2001 Miller
6,314,422 B1 11/2001 Barker et al.
6,321,151 B1 11/2001 Shultz
6,356,823 B1 3/2002 Iannotti et al.
6,360,551 B1 3/2002 Renders
6,374,315 B1 4/2002 Okada et al.
6,385,300 B1 5/2002 Mohammadian et al.
6,401,049 B1 6/2002 Ehmer
6,416,471 B1 7/2002 Kumar et al.
6,421,631 B1 * 7/2002 Wietzke ..... G01R 31/2825 701/32.8
6,477,478 B1 11/2002 Jones et al.
6,487,478 B1 11/2002 Azzaro et al.
6,609,050 B2 8/2003 Li
6,622,070 B1 9/2003 Wacker et al.
6,640,166 B2 10/2003 Liebl et al.
6,662,123 B2 12/2003 Maeckel et al.
6,693,367 B1 2/2004 Schmeisser et al.
6,711,524 B2 3/2004 Wolf et al.
6,745,151 B2 6/2004 Marko et al.
6,748,335 B2 6/2004 Pickerd
6,757,521 B1 6/2004 Ying
6,778,931 B1 8/2004 Letts et al.
6,789,007 B2 9/2004 Ellis et al.
6,802,032 B1 10/2004 Budinger et al.
6,807,469 B2 10/2004 Funkhouser et al.
6,807,496 B2 10/2004 Pickerd
6,822,639 B1 11/2004 Silverbrook et al.
6,823,243 B2 11/2004 Chinnadurai et al.
6,844,823 B2 1/2005 Hooks et al.
6,847,916 B1 1/2005 Ying
6,873,940 B1 3/2005 Kamatani
6,947,043 B1 9/2005 Klingman et al.
6,957,128 B1 10/2005 Ito et al.
6,959,235 B1 10/2005 Abdel-Malek et al.
6,972,669 B2 12/2005 Saito et al.
6,982,653 B2 1/2006 Voeller et al.
6,988,053 B2 1/2006 Namaky
7,020,546 B2 3/2006 Nagai et al.
7,023,332 B2 4/2006 Saito et al.
7,073,714 B2 7/2006 Namaky et al.
7,124,058 B2 10/2006 Namaky et al.
7,155,321 B2 12/2006 Bromley et al.
7,200,483 B1 4/2007 Kavadeles
7,224,262 B2 5/2007 Simon et al.
7,251,552 B2 7/2007 Schmeisser et al.
7,254,550 B2 8/2007 Reichwein et al.
7,269,482 B1 9/2007 Shultz et al.
7,272,476 B2 9/2007 Ortiz et al.
7,281,663 B2 10/2007 Schmidt et al.
7,294,906 B2 11/2007 Ukaji
7,327,228 B2 2/2008 Min et al.
7,336,082 B1 2/2008 Mofield
7,350,159 B2 3/2008 Cancilla et al.
7,363,129 B1 4/2008 Barnicle et al.
7,383,318 B2 6/2008 Craik
7,444,216 B2 10/2008 Rogers et al.
7,504,926 B2 3/2009 Bessho et al.
7,530,949 B2 5/2009 Al Ali et al.
7,535,466 B2 5/2009 Sampsell et al.
7,580,781 B2 8/2009 Mindeman
7,613,554 B2 11/2009 Rollinger et al.
7,634,337 B2 12/2009 Brozovich et al.
7,648,062 B2 1/2010 Corniot
7,702,437 B2 4/2010 Gilbert
7,711,462 B2 5/2010 Daniels et al.
7,737,860 B2 6/2010 Banta et al.
7,751,955 B2 7/2010 Chinnadurai et al.
8,019,503 B2 9/2011 Andreasen et al.
8,095,261 B2 1/2012 Howell et al.
8,370,018 B2 2/2013 Andreasen et al.
8,412,401 B2 4/2013 Bertosa et al.
8,463,953 B2 6/2013 Davis et al.
8,670,437 B2 3/2014 Walker et al.
2001/0001850 A1 5/2001 Miller
2002/0007237 A1 1/2002 Phung et al.
2002/0040261 A1 * 4/2002 Nakamoto et al. ..... 701/1
2002/0077780 A1 6/2002 Leibl et al.
2003/0020759 A1 1/2003 Cancilla et al.
2003/0034767 A1 2/2003 Lipscomb et al.
2003/0036832 A1 2/2003 Kokes et al.
2003/0058243 A1 3/2003 Faust et al.
2003/0088346 A1 5/2003 Calkins et al.
2003/0122671 A1 7/2003 Jespersen
2003/0208328 A1 11/2003 Pickerd
2003/0208330 A1 11/2003 Pickerd
2003/0222873 A1 12/2003 Ritter
2004/0054503 A1 3/2004 Namaky
2004/0167997 A1 * 8/2004 Ikeda ..... 710/15
2004/0172177 A1 9/2004 Nagai et al.
2005/0083965 A1 4/2005 Sodergren
2005/0094588 A1 5/2005 Wentink
2005/0152294 A1 7/2005 Yu et al.
2005/0157732 A1 7/2005 Joy et al.
2005/0182537 A1 8/2005 Tefft et al.
2005/0267655 A1 12/2005 Gessner
2006/0025897 A1 2/2006 Shostak et al.
2006/0036355 A1 2/2006 Schaar et al.
2006/0062190 A1 3/2006 Suga
2006/0078175 A1 4/2006 Brozovich
2006/0095230 A1 5/2006 Grier et al.
2006/0101311 A1 * 5/2006 Lipscomb et al. ..... 714/47

(56) References Cited

U.S. PATENT DOCUMENTS

| | | | | |
|---|---|---|---|---|
| 2006/0106508 | A1 | 5/2006 | Liebl et al. | |
| 2006/0149434 | A1 | 7/2006 | Bertosa et al. | |
| 2006/0180371 | A1 | 8/2006 | Breed et al. | |
| 2006/0199537 | A1 | 9/2006 | Eisenbach | |
| 2006/0212239 | A1 | 9/2006 | Letts et al. | |
| 2006/0212540 | A1 | 9/2006 | Chon et al. | |
| 2006/0226298 | A1 | 10/2006 | Pierson | |
| 2007/0010922 | A1* | 1/2007 | Buckley | 701/29 |
| 2007/0043488 | A1 | 2/2007 | Avery et al. | |
| 2007/0073459 | A1 | 3/2007 | Webster et al. | |
| 2007/0073460 | A1* | 3/2007 | Bertosa et al. | 701/29 |
| 2007/0083307 | A1 | 4/2007 | Pasztor et al. | |
| 2007/0100520 | A1 | 5/2007 | Shah et al. | |
| 2007/0146133 | A1 | 6/2007 | Wehrenberg | |
| 2007/0156311 | A1 | 7/2007 | Elcock et al. | |
| 2007/0156313 | A1 | 7/2007 | Fudali et al. | |
| 2007/0200550 | A1 | 8/2007 | Corredoura | |
| 2007/0244611 | A1 | 10/2007 | Brozovich | |
| 2007/0244614 | A1 | 10/2007 | Nathanson | |
| 2007/0288134 | A1 | 12/2007 | Rollinger et al. | |
| 2007/0290847 | A1 | 12/2007 | Harrington et al. | |
| 2007/0294556 | A1 | 12/2007 | Wutka | |
| 2008/0003997 | A1 | 1/2008 | Parkkinen et al. | |
| 2008/0004764 | A1 | 1/2008 | Chinnadurai et al. | |
| 2008/0015748 | A1 | 1/2008 | Nagy | |
| 2008/0033609 | A1 | 2/2008 | Razavi | |
| 2008/0070501 | A1 | 3/2008 | Wyld | |
| 2008/0076389 | A1 | 3/2008 | Lee et al. | |
| 2008/0082221 | A1 | 4/2008 | Nagy | |
| 2008/0082278 | A1 | 4/2008 | Tan et al. | |
| 2008/0103658 | A1* | 5/2008 | Boac et al. | 701/36 |
| 2008/0122288 | A1 | 5/2008 | Plante et al. | |
| 2008/0125067 | A1 | 5/2008 | Bells et al. | |
| 2008/0140281 | A1 | 6/2008 | Morris et al. | |
| 2008/0228344 | A1 | 9/2008 | Sampson et al. | |
| 2008/0248748 | A1 | 10/2008 | Sangster et al. | |
| 2008/0271107 | A1 | 10/2008 | Shioyama et al. | |
| 2008/0285659 | A1 | 11/2008 | Raines et al. | |
| 2008/0319665 | A1* | 12/2008 | Berkobin et al. | 701/213 |
| 2009/0125351 | A1 | 5/2009 | Davis, Jr. | |
| 2009/0150970 | A1 | 6/2009 | Hinds et al. | |
| 2009/0253410 | A1 | 10/2009 | Fitzgerald et al. | |
| 2009/0259349 | A1 | 10/2009 | Golenski | |
| 2009/0265057 | A1 | 10/2009 | Chinnadurai et al. | |
| 2009/0276115 | A1 | 11/2009 | Chen | |
| 2009/0288009 | A1 | 11/2009 | Dulaney | |
| 2009/0299539 | A1 | 12/2009 | Chinnadurai et al. | |
| 2009/0307188 | A1 | 12/2009 | Oldham et al. | |
| 2010/0042288 | A1 | 2/2010 | Lipscomb et al. | |
| 2010/0076644 | A1 | 3/2010 | Cahill et al. | |
| 2010/0100646 | A1 | 4/2010 | Park | |
| 2010/0128632 | A1 | 5/2010 | Mantysalo | |
| 2010/0179717 | A1* | 7/2010 | Gilbert | 701/29 |
| 2010/0205450 | A1 | 8/2010 | Sarnacke et al. | |
| 2011/0141953 | A1 | 6/2011 | Wright et al. | |
| 2011/0153798 | A1 | 6/2011 | Groenendaal et al. | |
| 2011/0313593 | A1 | 12/2011 | Cohen et al. | |
| 2012/0044086 | A1 | 2/2012 | Ruther et al. | |
| 2012/0044527 | A1 | 2/2012 | Panko | |
| 2012/0044607 | A1 | 2/2012 | Loewe | |
| 2012/0045927 | A1 | 2/2012 | Panko et al. | |
| 2012/0046807 | A1 | 2/2012 | Ruther et al. | |
| 2012/0046824 | A1 | 2/2012 | Ruther et al. | |
| 2012/0046825 | A1 | 2/2012 | Ruther et al. | |
| 2012/0046826 | A1 | 2/2012 | Panko | |
| 2012/0046897 | A1 | 2/2012 | Panko | |
| 2012/0047289 | A1 | 2/2012 | Krzystofczyk et al. | |
| 2012/0047291 | A1 | 2/2012 | Davis et al. | |
| 2012/0047458 | A1 | 2/2012 | Alberry et al. | |
| 2012/0047499 | A1 | 2/2012 | Krzystofczyk et al. | |
| 2012/0215398 | A1 | 8/2012 | Chen et al. | |
| 2013/0295912 | A1 | 11/2013 | Chen | |
| 2013/0297143 | A1 | 11/2013 | Chen et al. | |

FOREIGN PATENT DOCUMENTS

| | | | |
|---|---|---|---|
| DE | 202009009035 | U1 | 9/2009 |
| GB | 2277807 | A | 11/1994 |
| GB | 2385934 | A | 9/2003 |
| GB | 2405486 | A | 3/2005 |
| JP | 2008233970 | A | 10/2008 |
| WO | 9956201 | A1 | 11/1999 |
| WO | 00/34838 | A1 | 6/2000 |
| WO | 01/59601 | A1 | 8/2001 |
| WO | 0155690 | A1 | 8/2001 |
| WO | 0167420 | A1 | 9/2001 |
| WO | 0186576 | A1 | 11/2001 |
| WO | 2005121814 | A1 | 12/2005 |
| WO | 2006008527 | A2 | 1/2006 |
| WO | 2006/050454 | A2 | 5/2006 |
| WO | 2006055289 | A2 | 5/2006 |
| WO | 2006110786 | A2 | 10/2006 |
| WO | 2007022426 | A2 | 2/2007 |
| WO | 2007038983 | A1 | 4/2007 |
| WO | 2007058607 | A1 | 5/2007 |
| WO | 2008063818 | A2 | 5/2008 |
| WO | 2009137584 | A1 | 11/2009 |
| WO | 2009149007 | A1 | 12/2009 |
| WO | 2010019771 | A1 | 2/2010 |

OTHER PUBLICATIONS

European Patent Office, Written Opinion of the International Searching Authority for International Application No. PCT/US2011/047323, Nov. 7, 2011.

Bluetooth Sig Inc., Bluetooth Specification Version 4.0, vol. 2, "Core System Package [BR/EDR Controller volume]," Part C "Link Manager Protocol Specification," Section 4.2 "Security", pp. 247-275, Jun. 30, 2010.

Engineer Live, "Ethernet makes it way into the car," Article date: Jun. 9, 2009, downloaded from the World Wide Web at http://www.engineerlive.com/Design-Engineer/Automotive_Design/Ethernet_makes_its_way_into_the_car/21822/ on Jul. 25, 2011, 4 pages.

OBD-II PIDs, downloaded from the World Wide Web at http://web.archive.org/web/20100329141311/http://en.wikipedia.org/wiki/OBD-II_PIDs, as available on Mar. 29, 2010, 13 pages.

Sorion Electronic Limited, J1962—OBD Diagnostics Connectors, downloaded from World Wide Web at http://www.sorion-group.com/SEL0051_connector.htm on May 24, 2010, pp. 1-3.

Memopad, The OBD2 Cable for Allpro adapter, downloaded from the World Wide Web at http://datawave.oommm.com/entry/USB-OBD2-AllPro-adapter, pp. 1-16, Oct. 8, 2008.

Tyco Electronics, Fundamentals of PolySwitch Overcurrent and Overtemperature Devices, pp. 1-13, Sep. 2, 2009.

International Organization for Standardization, ISO TC 22/SC 3, ISO 15031-1:2001(E), Road vehicles—Communication between vehicle and external test equipment for emissions-related diagnostics—Part 1: General information, 36 pages, Aug. 5, 2001.

International Organization for Standardization, ISO TC 22/SC 3 N, ISO/CD 22900-2, Road vehicles, Modular VCI (Vehicle Communication Interface)—Part 2: D-PDU API (Diagnostic Protocol Data Unit Application Programmer Interface), 144 pages, Mar. 31, 2005.

International Organization for Standardization, ISO TC 22/SC 3 N, ISO/CD 22900-1, Road vehicles—Modular Vehicle Communication Interface (MVCI)—Part 1: Hardware design requirements, 29 pages, Mar. 31, 2005.

International Organization for Standardization, ISO TC 22/SC 3 N, ISO/CD 22900-1, Road vehicles—Modular Vehicle Communication Interface (MVCI)—Part 3: D-Server API (Diagnostic Server Application Programmer Interface), 159 pages, Mar. 31, 2005.

International Organization for Standardization, ISO 15031-3:2400(E), Road vehicles—Communication between vehicle and external equipment for emissions-related diagnostics—Part 3: Diagnostic connector and related electrical circuits, specification and use—Annex B pp. 17-18, Jul. 2004.

(56) References Cited

OTHER PUBLICATIONS

Vital Engineering, Support and Frequently Asked Question regarding the Car-Pal OBD Interface Unit, Jan. 4, 2007, downloaded from the World Wide Web at http://www.vitalengineering.co.uk/support.htm, 8 pages.
Tech Shop Magazine; Snap-on Introduces VERDICT Diagnostic and Information System; Aug. 26, 2010; downloaded from the World Wide Web at http://www.techshopmag.com/Controls/PrinterFriendly/PrinterFriendly.aspx, 3 pages.
Snap-On Incorporated, Modis, Scanner Plug-in User Manual, ZEEMS303L, Rev. A, Aug. 2009, 61 pages.
Snap-On Incorporated, Modis, Display User Manual, ZEEMS300N, Rev. A, Aug. 2009, 72 pages.
Snap-On Incorporated, Modis, Component Tests User Manual, ZEEMS308G, Rev. C, Feb. 2009, 52 pages.
Snap-On Incorporated, Modis, Flexible Gas Analyzer User Manual, ZEEMS306B, Rev. A, Aug. 2009, 47 pages.
Snap-On Incorporated, Modis, Lab Scope Plug-in User Manual, ZEEMS305K, Rev. C, Feb. 2009, 73 pages.
Zussman, Gil et al, Bluetooth Time Division Duplex Analysis as a Polling System, Aug. 19, 2004.
Fluke Corporation, Digital Multimeters, downloaded from the World Wide Web at http://us.fluke.com/usen/products/categorydmm on Jan. 28, 2010.
Fluke Corportation, 233 True=rms Remote Display Digital Multimeter Users Manual, Sep. 2009.
Bluetooth Sig, Inc., Bluetooth Architecture—Data Transport, downloaded from the World Wide Web at http://www.bluetooth.com/KnowledgeCenter/TechnologyOverview/Pages/DataTransport.aspx on May 6, 2010.
Shigeru et al, DL7100 Signal Explorer, a High-Speed Digital Oscilloscope with Long Record Length, Yokogawa Electric Corporation, Yogogawa Technical Report English Edition, No. 30, (2000).
Bluetomorrow.com, Bluetooth Pairing, downloaded from the World Wide Web at www.bluetomorrow.com on Apr. 30, 2010.
Snap-On Diagnostics, Snap-on Introduces VERDICT Diagnostic and Information System, Aug. 24, 2010.
Testpath, Inc., Fluke Meter Holsters, downloaded from the World Wide Web at http://www.testpath.com/Categories/Fluke-Meter-Holsters-2220.htm on May 6, 2010.
BMW Canada, Bluetooth Pairing Instructions, Sep. 2009.
Accessory Geeks, Bluetooth Pairing Guides, downloaded from the World Wide Web at http://www.accessorygeeks.com/bluetooth-pairing-guide1.html on Apr. 30, 2010.
Quatech, Inc., Bluetooth Communication Overview, downloaded from the World Wide Web at http://www.quatech.com/support/comm-over-bluetooth.php on May 3, 2010.
Omitec Limited, T4 Diagnostic System, downloaded from the World Wide Web at http://web.archive.org/web/20091119041838/http://www.omitec.com/us/products/diagnostic-testers/t4-diagnostic-system/ as archived on Nov. 19, 2009.
Omitec Limited, Workstations, downloaded from the World Wide Web at http://web.archive.org/web/20100322213801/http://www.omitec.com/us/products/workstation/ as archived on Mar. 22, 2010.
Anotherurl.com, Bluetooth, What is Bluetooth? downloaded from the World Wide Web at http://www.anotherurl.com/library/bluetooth_research.htm on May 17, 2010,verdict.
Snap-On Incorporated, EEDM604C, Multimeter, Digital, Automotive, True RMS, Auto Ranging, Hybrid Vehicles, downloaded from the World Wide Web at http://buy1.snapon.com/catalog/item.asp?store=snapon-store&item_ID=88136&group_ID=1367 on May 4, 2010.
Snap-On Incorporated, EEDM596DK, Multimeter, Digital, Advanced, Manual Ranging, downloaded from the World Wide Web at http://buy1.snapon.com/catalog/item.asp?store=snapon-store&item_ID=84657&group_ID=1367 on May 4, 2010.
Snap-On Incorporated, EEDM503D, Multimeter, Digital, Automotive, True RMS, downloaded from the World Wide Web at http://buy1.snapon.com/catalog/item.asp?store=snapon-store&item_ID=84656&groupID=1367 on May 4, 2010.
Fluke, 163/164 MultiFunction Counter Users Manual, Feb. 1, 1997.
Fluke, Fluke 164 2.7 GHz Multifunction Counter Technical Data, May 10, 2007.
Report Lab, OBD-II PIDS, Jul. 6, 2010.
Flores, J., Wireless Diagnostics and Consultancy Services, Vital Engineering, Jan. 4, 2007.
Fluke, Fluke 199B / 003 Scopemeter 200 MHz, Dual Portable Multimeter and Oscilloscope, downloaded from the World Wide Web at http://web.archive.org/web/20100413065253/http://www.fluke199.com/ as archived on Apr. 12, 2010.
Fluke Corporation, ScopeMeter 120 and 190 Series incl. 225C and 215C, Technical Data, Jan. 2010.
Fluke Corporation, Fluke 19xC-2x5C Scopemeter, Software version 8.00 onwards, Users Manual, Jul. 2008.
Metzelaar, R.H.M., Peugeot 205 Holding Back.
Jones, Mike, Senior FAE, Micrel Inc., Ethernet Driving Down Automotive Cost of Ownership; Oct. 31, 2008.
Nucology Engineering, Inc., Nology, PDA-Dyno and OBD II Scan Tool Operating Manual, 2009.
Obd-2.com, OBDII Automotive Scan Tool and Virtual Dashboard, downloaded from the World Wide Web at http://www.obd-2.com/ on Jul. 11, 2010.
U.S. Appl. No. 12/859,077, filed Aug. 18, 2010.
U.S. Appl. No. 12/858,699, filed Aug. 18, 2010.
U.S. Appl. No. 12/859,082, filed Aug. 18, 2010.
U.S. Appl. No. 13/189,940, filed Jul. 25, 2011.
U.S. Appl. No. 13/205,318, filed Aug. 8, 2011.
U.S. Appl. No. 13/198,974, filed Aug. 5, 2011.
U.S. Appl. No. 12/913,249, filed Oct. 27, 2010.
U.S. Appl. No. 12/913,184, filed Oct. 27, 2010.
U.S. Appl. No. 12/859,011, filed Aug. 18, 2010.
U.S. Appl. No. 12/859,040, filed Aug. 18, 2010.
U.S. Appl. No. 12/858,725, filed Aug. 18, 2010.
U.S. Appl. No. 13/198,530, filed Aug. 4, 2011.
U.S. Appl. No. 12/859,051, filed Aug. 18, 2010.

* cited by examiner

SYSTEM AND METHOD FOR A VEHICLE SCANNER TO AUTOMATICALLY EXECUTE A TEST SUITE FROM A STORAGE CARD

RELATED APPLICATIONS

This application claims priority to U.S. provisional patent application No. 61/374,930 filed on Aug. 18, 2010. U.S. provisional patent application No. 61/374,930 is incorporated herein by reference.

BACKGROUND

Vehicles, such as automobiles, light-duty trucks, and heavy-duty trucks, play an important role in the lives of many people. To keep vehicles operational, some of those people rely on vehicle technicians to diagnose and repair their vehicle.

Vehicle repair technicians use a variety of tools in order to diagnose and/or repair vehicles. Those tools may include common hand tools, such as wrenches, hammers, pliers, screwdrivers and socket sets, or more vehicle-specific tools, such as cylinder hones, piston ring compressors, and vehicle brake tools.

Modern vehicles have evolved into very complex machines with thousands of various parts that perform a vast array of operations that permit the vehicle to be operated by the user. Additionally, more and more vehicle operations that previously were controlled by mechanical interactions are instead being controlled by electronic control circuits and logic. As with any such complex machine, malfunctions may occur in one or more parts of the vehicle from time to time, including the electronic control circuits.

As a result, repair technicians must now rely on sophisticated electronic equipment to diagnose and repair vehicular malfunctions. In order to ease the repair technician's access to the electronic equipment within the vehicle, modern vehicles include an on-board diagnostic port (OBD port) or a diagnostic link connector (DLC). An OBD port or DLC generally comprises a plug-in type connector that is coupled to an on-board computer within the vehicle. The on-board computer is then coupled to various sensors at various places within the vehicle. The sensors can report current operating characteristics of vehicle elements and/or sense the existence of a malfunction in the various vehicle elements. By plugging in an appropriate scanner device into the OBD or DLC, status or error codes can be retrieved from the OBD or DLC. These error codes may provide information as to the source of a malfunction in the electronic control circuits in the vehicle.

In order to further process data received from the DLC or OBD port, a diagnostic scanner device may transmit the vehicle diagnostic data to another, more robust processing device, such as a display device. The display device may further contain a substantial database of information about the particular vehicle from which the data is retrieved, and may correlate the error codes retrieved to particular malfunctions and perhaps display further diagnostic steps that may be taken to diagnose the problem, including the retrieval of additional diagnostic information from the OBD or DLC port via the vehicle scanner device.

By providing the repair technician with detailed information for quickly diagnosing and repairing vehicles, vehicle repair times can be decreased, vehicle turn-over is increased, and as a result, repair technicians may reap increased profits from a same amount of garage space.

Overview

Vehicle scanners tend to fall into one of two categories: large all-in-one devices that directly plug in to the OBD or DLC connector and provide trouble code information and diagnostic information, or smaller single function devices that plug into the OBD or DLC connector and also plug into a more powerful display device and simply stream diagnostic data from the vehicle interface to the display device interface via wire-line cables or connectors.

Disclosed herein are methods and systems that provide for a compact vehicle scanner that may automatically execute pre-defined functions and/or test suites from a removable storage medium. By providing for an ability to detect the presence of a removable storage medium containing one or more test suites; and for a method and apparatus for automatically executing the detected test suites, repair technician time spent on diagnosing vehicles may be reduced and repair technician learning curves also reduced. Furthermore, a variety of pre-defined test suites may be provided to repair technicians by a manufacturer to allow for various targeted tests to be executed by a vehicle scanner by simply choosing and inserting into the vehicle scanner a corresponding memory card labeled with, and including, the desired targeted test suite. The results of the test can be stored back onto the card for further diagnosis at a later time, or may be transmitted via a wired or wireless connection back to a display device for further analysis and trouble shooting. A post-manufacturing test suite my also be loaded onto a corresponding memory card and inserted into the vehicle scanner after manufacture to determine whether any faults were introduced into the device during manufacture.

In accordance with a first embodiment of a vehicle scanner, a method of monitoring and processing vehicle diagnostic data includes detecting a presence of one or more executable test suites in removable data storage and, responsive to the detection, transmitting one or more corresponding requests for vehicle diagnostic data to the vehicle via a vehicle interface. Furthermore, the vehicle scanner may process vehicle diagnostic data received from the vehicle interface responsive to the transmission. Processing the vehicle diagnostic data may include routing the vehicle diagnostic data to the removable data storage, routing the vehicle diagnostic data to a wireless interface for transmission to a display device, and/or routing the vehicle diagnostic data to a wire-line communications interface for transmission to a display device.

In accordance with a second embodiment, a method of determining proper manufacture and operation of a vehicle scanner includes detecting a presence of one or more executable test suites in removable data storage and, responsive to the detection, executing one or more corresponding post-manufacture tests. The post-manufacture tests may comprise tests that stress a processor, a memory device, an input/output port, or some other circuit element within the vehicle scanner. After executing the tests, the vehicle scanner may provide a visual indication of whether the device passed the tests. Resulting test data may be stored back to removable data storage or routed to a wired or wireless interface for transmission to an external device.

Detecting a presence of one or more executable diagnostic requests in the removable data storage may comprise the vehicle scanner, responsive to receiving power from the vehicle interface, automatically accessing the removable data storage, locating one or more executable diagnostic requests in a test suite, and executing the one or more diagnostic requests. Alternatively, detecting the presence may include receiving a signal upon insertion of a removable data storage card in a removable data storage slot and, responsive to receiving the signal, automatically accessing the removable data storage, locating one or more executable diagnostic requests in a test suite, and executing the diagnostic requests. In the latter case, the signal may be generated by activation of a mechanical switch upon insertion of the removable data storage card in the removable data storage slot or by completion of an electrical circuit upon insertion of the removable data storage in the removable data storage slot. Other methods of generating an insertion signal may also be used.

Additionally, prior to executing any vehicle diagnostic requests stored on the removable data storage, vehicle scanner may authenticate the removable data storage using one or more authentication steps to prevent use of unauthorized removable data storage cards and/or to prevent the execution of potentially malicious code.

These, as well as other aspects and advantages, will become apparent to those of ordinary skill in the art by reading the following detailed description, with reference where appropriate to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments of the invention are described herein with reference to the drawings, in which.

DETAILED DESCRIPTION

I. Example Architecture

Figure 1:
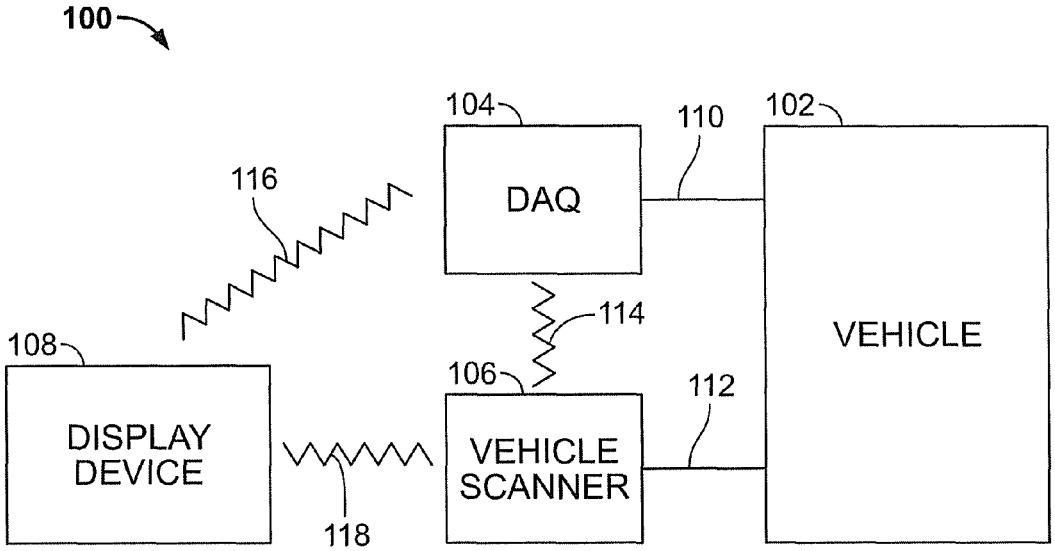
FIG. 1 is a block diagram of a system in which a vehicle scanner in accordance with an example embodiment may operate.

FIG. 1 is a block diagram of a system 100 in accordance with an example embodiment. System 100 comprises a vehicle 102, a data acquisition device (DAQ) 104, a vehicle scanner 106, and a controller/display device 108 (display device).

The block diagram of FIG. 1 and other block diagrams and flow charts accompanying this description are provided merely as examples and are not intended to be limiting. Many of the elements illustrated in the figures and/or described herein are functional elements that may be implemented as discrete or distributed components or in conjunction with other components, and in any suitable combination and location. Those skilled in the art will appreciate that other arrangements and elements (for example, machines, interfaces, functions, orders, and groupings of functions, etc.) can be used instead. Furthermore, various functions described as being performed by one or more elements can be carried out by a processor executing computer-readable program instructions from a computer readable medium and/or by any combination of hardware, firmware, and software.

DAQ 104 and vehicle scanner 106 may connect to a device-under-service such as vehicle 102 via wired links 112 and 114, respectively. The vehicle 102 may comprise an automobile, a motorcycle, a semi-tractor, farm machinery, or some other motorized vehicle. System 100 is operable to carry out a variety of functions, including functions for servicing device-under-service 102. The example embodiments may include or be utilized with any appropriate voltage or current source, such as a battery, an alternator, a fuel cell, and the like, providing any appropriate current and/or voltage, such as about 12 volts, about 42 volts, and the like. The example embodiments may be used with any desired system or engine. Those systems or engines may comprise items utilizing fossil fuels, such as gasoline, natural gas, propane, and the like, electricity, such as that generated by battery, magneto, fuel cell, solar cell and the like, wind and hybrids or combinations thereof. Those systems or engines may be incorporated into other systems, such as an automobile, a truck, a boat or ship, a motorcycle, a generator, an airplane and the like. DAQ 104 and vehicle scanner 106 may include batteries that provide operational power, or may receive operating power through their respective wired links 112 and 114 with the vehicle 102.

Each of the DAQ 104, vehicle scanner 106, and display device 108 may create and/or maintain a wireless link with any of the other devices via respective wireless links 114, 116, and 118. The wireless links 114, 116, and 118 may operate via a same wireless protocol, or via different wireless protocols, the only limitation being that each pair of wirelessly communicating devices in FIG. 1 must both support the particular wireless protocol.

Each of the one or more wireless links 114, 116, and 118 may be arranged to carry out communications according to an industry standard, such as an Institute of Electrical and Electronics Engineers (IEEE) 802 standard. The IEEE 802 standard may comprise an IEEE 802.11 standard for Wireless Local Area Networks (e.g., IEEE 802.11a, b, g, or n), an IEEE 802.15 standard for Wireless Personal Area Networks, an IEEE 802.15.1 standard for Wireless Personal Area Networks—Task Group 1, an IEEE 802.16 standard for Broadband Wireless Metropolitan Area Networks, or some other IEEE 802 standard. For purposes of this description, a wireless network arranged according to the IEEE 802.11 standard can be referred to as a Wi-Fi network, and a wireless network arranged according to the IEEE 802.15.1 can be referred to as a Bluetooth (BT) network. Other protocols could also or alternatively be used.

Each of the devices 104, 106, and 108 may transmit data and/or commands to one another via the wireless links 114, 116, 118. As an example, display device 108 may establish a wireless link 116 with DAQ 104 and send an instruction to the DAQ 104 to switch to "voltmeter mode." DAQ 104 may then respond by taking a voltage reading from the vehicle 102 and transmitting the voltage reading to display device 108. Other instruction and data communications could also be used.

DAQ 104 may be a data acquisition device as set forth in co-pending application titled "Method And Apparatus To Use Remote And Local Control Modes To Acquire And Visually Present Data," and given U.S. Application Ser. No.

61/374,723, which is herein incorporated by reference in its entirety. Briefly, DAQ 104 may comprise a display, a wireless interface to display device 108, test leads, and logic configured to take measurements from the vehicle 102, including, for example, direct current (DC) voltage readings, alternating voltage (AC) voltage readings, and resistance readings. DAQ 104 may also provide test modes such as a diode test/continuity test mode and a capacitance test mode. An oscilloscope mode may also be provided such that a waveform is displayed on the DAQ's 104 display. DAQ 104 may include an input interface, such as a rotary switch, to choose from amongst the various measurement, test, and display modes. The DAQ 104 may also be placed into a "remote control" mode in which the display device 108 determines what measurement, test, and/or display mode the DAQ 104 is set to via commands sent to the DAQ 104 over the wireless link 116. Other features or characteristics may also be implemented.

Figure 2:
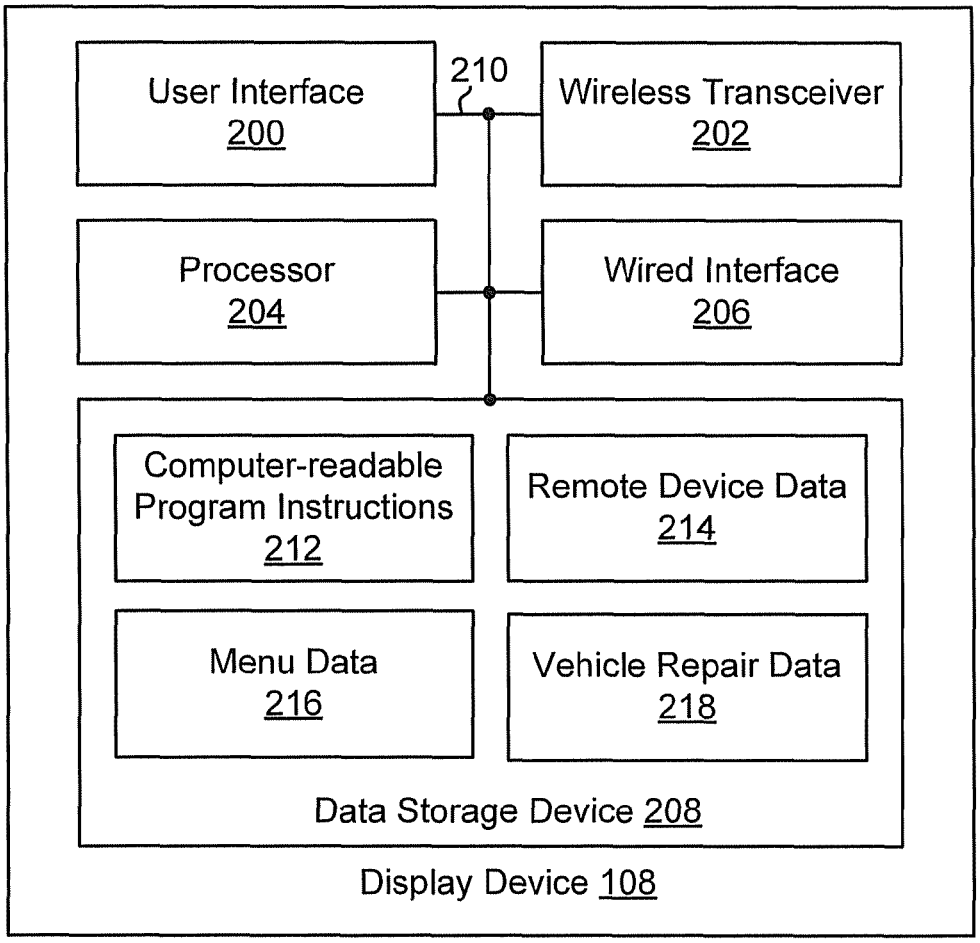
FIG. 2 is a block diagram of an example vehicle scanner.

Next, FIG. 2 is a block diagram of display device 108, which includes a user interface 200, a wireless transceiver 202, a processor 204, a wired interface element 206, and a data storage device 208, all of which may be linked together via a system bus, network, or other connection mechanism 210.

User interface 200 is operable to present data to a user and to enter user selections. User interface 200 may include a display 300 (illustrated in FIG. 3) that is operable to visually present input data transmitted to wireless transceiver 206 from a vehicle scanner 106 or DAQ 104. Display 300 may also simultaneously display input data received from multiple remote devices, such as input data received from both DAQ 104 and vehicle scanner 106. Display 300 may also display data stored at data storage device 208, such as menu data 216 or vehicle repair data 218. User interface 200 may further include an input selection element that is operable to enter a user selection. Examples of input selection elements are further illustrated in FIG. 3.

Wireless transceiver 202 comprises a wireless receiver and transmitter operable to carry out wireless communications with one or more of DAQ 104, vehicle scanner 106, and/or some other device that is operating within wireless communication range of display device 108. As an example, wireless transceiver 202 may comprise a transceiver that is operable to carry out communications via a BT network (e.g., a network that is operable to carry out communications via the IEEE 802.15.1 standard). For purposes of this description, a transceiver that is operable to carry out communications via a BT network can be referred to as a BT transceiver. As another example, wireless transceiver 202 may comprise a transceiver that is operable to carry out communications via a Wi-Fi network (e.g., a network that is operable to carry out communications via an IEEE 802.11 standard). For purposes of this description, a transceiver that is operable to carry out communications via a Wi-Fi network can be referred to as a Wi-Fi transceiver. Other wireless communications protocols could also or alternatively be used, including, for example, WiMAX, Cellular, ZigBee, Wireless USB, among others.

In accordance with an embodiment in which devices 104, 106 and display device 108 each include a single wireless transceiver (e.g., a BT transceiver), one of the devices, such as display device 108, may operate as a master device, and the other devices, such as DAQ 104 and vehicle scanner 106, may operate as slaves to the master. Vehicle scanner 106 and display device 108 may transmit communications via a wireless link 118 using, for example, a time-division duplex arrangement and synchronized to a clock signal of the master.

Wireless transceiver 202 is not limited to a single wireless transceiver. For example, wireless transceiver 202 may comprise a BT transceiver and a Wi-Fi transceiver. In accordance with such an example, the BT transceiver may communicate with DAQ 104 and/or vehicle scanner 106 via a BT network, and the Wi-Fi transceiver may communicate with DAQ 104 and/or vehicle scanner 106 via a Wi-Fi network.

In accordance with an embodiment in which display device 108 includes two transceivers (e.g., a BT transceiver and a Wi-Fi transceiver) and DAQ 104 and/or vehicle scanner 106 each include two transceivers (e.g., a BT transceiver and a Wi-Fi transceiver), DAQ 104 and/or vehicle scanner 106 may simultaneously transmit data to display device 108 for display via either one or both of the BT and Wi-Fi networks.

Each wireless transceiver of the example embodiments may operate in a transceiver-on-state. In the transceiver-on-state, the transceiver is powered on. While operating in the transceiver-on-state, the transceiver can transmit and receive data via an air interface. For some transceivers, while operating in the transceiver-on-state, the transceiver can transmit and receive data via the air interface simultaneously. For other transceivers, while operating in the transceiver-on-state, the transceiver can either transmit or receive data via the air interface at any given time. Each wireless transceiver of the example embodiments may also operate in a transceiver-off-state or low-power-state. While operating in the transceiver-off-state or low-power-state, the transceiver is powered off or in a low-power state and the transceiver refrains from transmitting and/or receiving data.

Wired interface 206 may include one or more wire-line ports. Each port provides an interface to display device 108 and to one or more circuits. In one respect, the one or more circuits may comprise electrical circuits, such as the electrical circuits of a Universal Serial Bus (USB) cable or the electrical circuits of an Ethernet cable (e.g., a CAT 5 cable). In another respect, the one or more circuits may comprise optical fibers that are operable to carry optical signals. Other examples of the one or more circuits are also possible.

Processor 204 may comprise one or more general purpose processors (e.g., INTEL microprocessors) and/or one or more special purpose processors (e.g., digital signal processors). Processor 204 may be configured to execute computer-readable program instructions (CRPI) 212 that are contained in computer-readable data storage device 208 and which cause the processor 204 to perform the functionality described below. For brevity in this description, CRPI are sometimes referred to as program instructions.

Data storage device 208 may comprise a computer-readable storage medium readable by processor 204. In the context of this document, a computer-readable medium is an electronic, magnetic, optical, or other physical device or means that can contain or store a computer program for use by, or in connection with, a computer related system or method. The methods can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. Data storage device 208 may contain various data including, but not limited to, CRPI 212, remote device data 214, menu data 216, and/or vehicle repair data 218.

Remote device data 214 may include data associated with a device that is arranged to communicate with display device 108 via wireless network 110. For example, remote device data 214 may include data associated with one of the DAQ 104 and vehicle scanner 106, such as a radio identifier, MAC address, security key, and/or password information. The associated data may be received at display device 108, for storing as remote device data 214, during a pairing process carried out between display device 108 and the DAQ 104 and/or vehicle scanner 106. For example, the pairing process between vehicle scanner 106 and display device 108 may include vehicle scanner 106 providing display device 108 with data associated with vehicle scanner 106 and display device 108 providing vehicle scanner 106 with data associated with display device 108. After carrying out the pairing process, display device 108 may use the stored remote device data 214 in establishing the communication link 118 with vehicle scanner 106. Remote device data 214 is not limited to data associated with one remote device. In that regard, remote device data 214 may also include data associated with DAQ 104 and other devices not illustrated in the figures.

Menu data 216 comprises data that can be visually presented via user interface 200. Menu data 216 may include, for example, icons and images that provide a user with a graphical representation of input and functionality options. Input elements may then be used to traverse the menu data 216 displayed on the display 300.

CRPI 212 may comprise program instructions that are executable by processor 204 to perform functions represented by the program instructions, such as operating system program instructions that provide for direct control and management of hardware components such as processor 204, data storage device 208, and user interface 200. The operating system can manage execution of other program instructions within CRPI 212. As an example, the operating system may comprise the Windows XP Embedded (XPe) operating system available from Microsoft Corporation, Redmond, Wash., United States. Other examples of the operating system are also possible.

CRPI 212 may further comprise program instructions (referred to herein as PI-212-A) that are executable by processor 204 so as to cause display device 108 to operate as a peripheral manager (PM) that manages functions carried out by peripheral devices, such as DAQ 104 and vehicle scanner 106.

CRPI 212 may further comprise program instruction (referred to herein as PI-212-B) that are executable by processor 204 to cause the wireless transceiver 202 to transmit instructions or mode-selection commands to one or more of DAQ 104 and vehicle scanner 106. In one respect, the instruction mode-selection command may be addressed to a specific remote device, such as vehicle scanner 106. In another respect, the instruction or mode-selection command may be broadcast to any device within a transmission range of the wireless transceiver 202. In either respect, the instruction or mode-selection command may or may not include data that identifies the display device 108 as the source of the instruction or mode-selection command.

Figure 3:
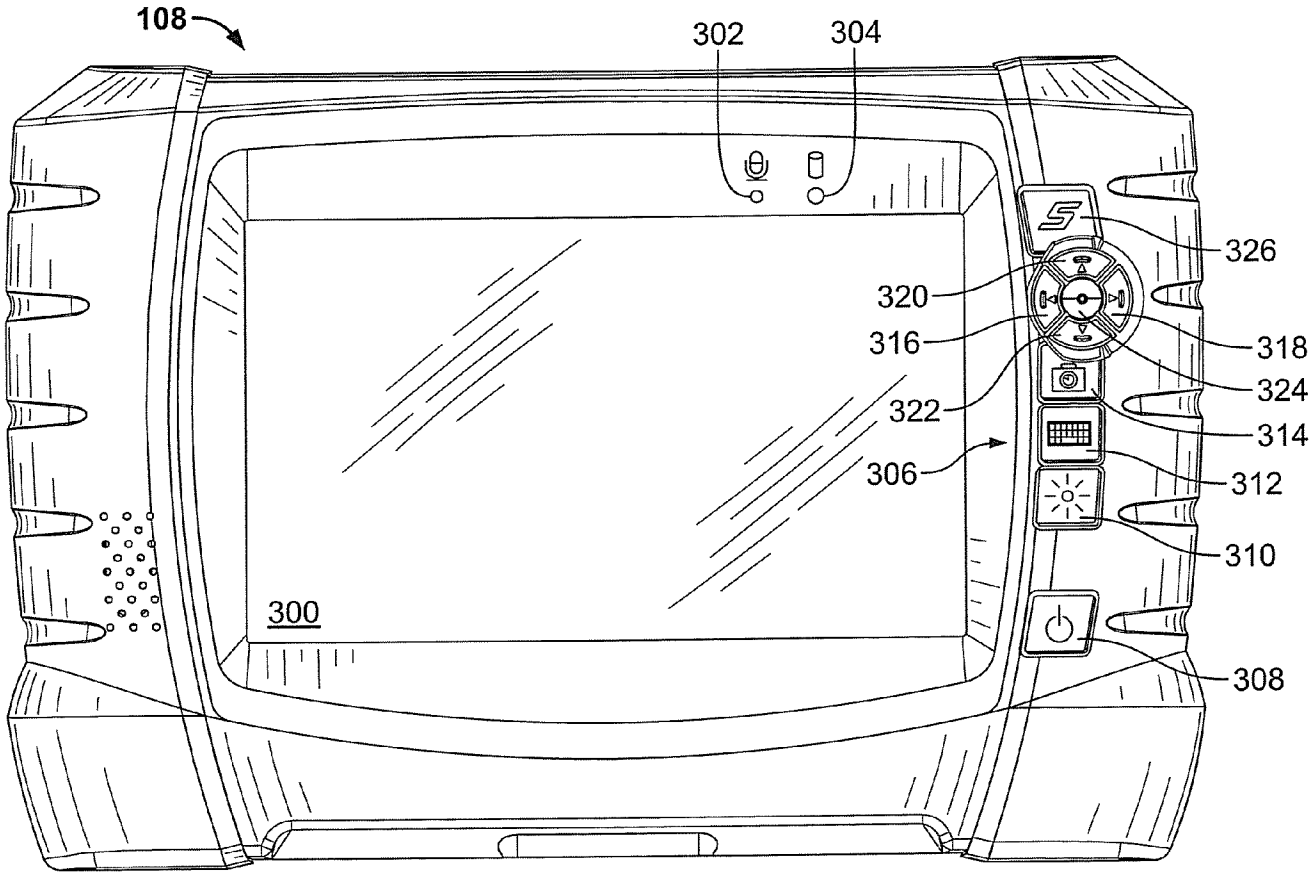
FIG. 3 illustrates a view of an example controller/display device.

Next, FIG. 3 illustrates a front view of an example embodiment of display device 108 with which vehicle scanner 106 may communicate. Display device 108 includes a display 300, a status indicator 304 (e.g., a light emitting diode (LED)), and user controls 306.

Display 300 may comprise a liquid crystal display (LCD), a plasma display, an electrophoretic display, or some other type of display. Display 300 is operable to visually present (e.g., display) data to a user, including, for example, vehicle diagnostic data transmitted to the display device 108 from vehicle scanner 106. For purposes of this description, data displayed at display device 108 is referred to as "displayed data." The data received from the vehicle scanner 106 and presented on the display 300 may take the form of an alphanumeric presentation, a graphical presentation, or some other type of presentation.

User controls 306 are operable to enter a user selection. User controls 306 may be arranged in various ways. In that regard, user controls 306 may be arranged to include a keypad, rotary switches, push buttons, or some other means to enter a user selection. As set forth in the example embodiment illustrated in FIG. 3, user controls 306 may include, among others, a power button 308, a brightness button 310, a keyboard button 312, a cursor left button 316, a cursor right button 318, a cursor up button 320, a cursor down button 322, a menu item selection button 324, and a quick access button 326. Table 1 lists example user selections that can be entered using user controls 306. Other examples of user controls 306 and other examples of user selections are also possible.

TABLE 1

| User Button | Example User Selection |
|---|---|
| Power button 308 | Turn display device 108 power on and off. |
| Brightness button 310 | Increase or decrease a brightness of display 300. |
| Keyboard button 312 | Display keyboard at display 300. |
| Cursor left button 316 | Move a cursor, displayed at display 300, to the left. |
| Cursor right button 318 | Move a cursor, displayed at display 300, to the right. |
| Cursor up button 320 | Move a cursor, displayed at display 300, upwards. |
| Cursor down button 322 | Move a cursor, displayed at display 300, downwards. |
| Menu item selection button 324 | Select a menu item from a displayed menu data. |
| Quick access button 326 | Select a function that pertains to a current operating mode of display device 108. |

Figure 4:
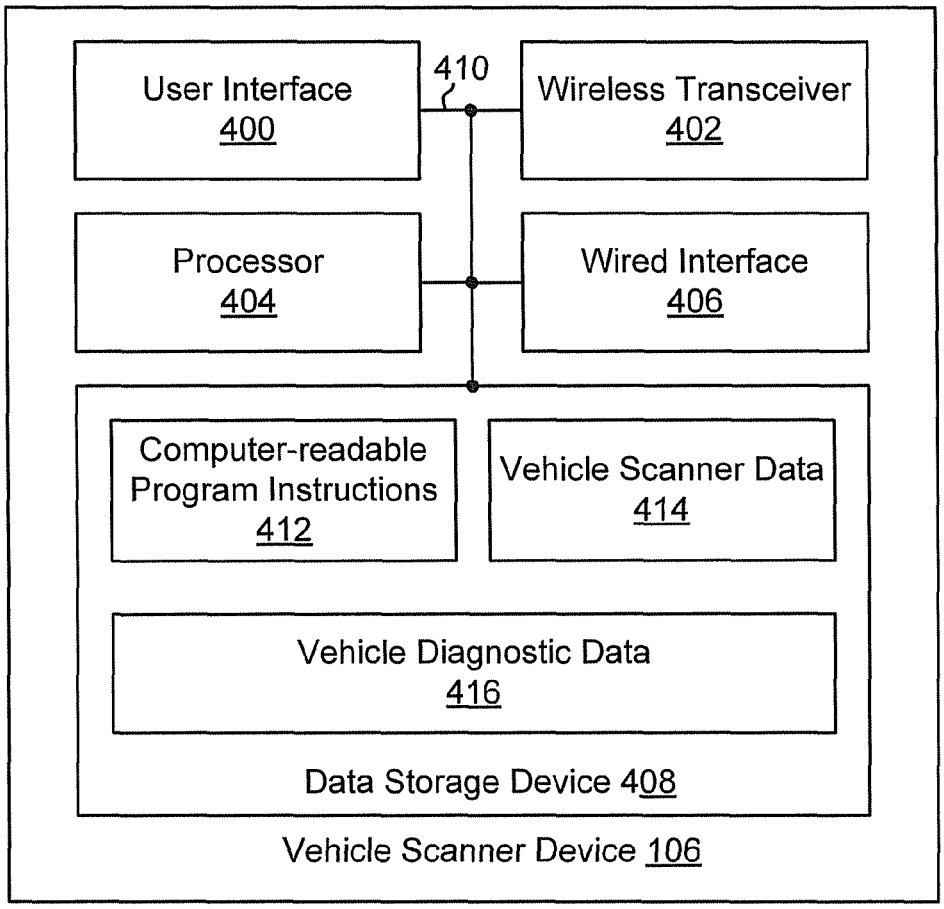
FIG. 4 is a block diagram of an example vehicle scanner.
Figure 5:
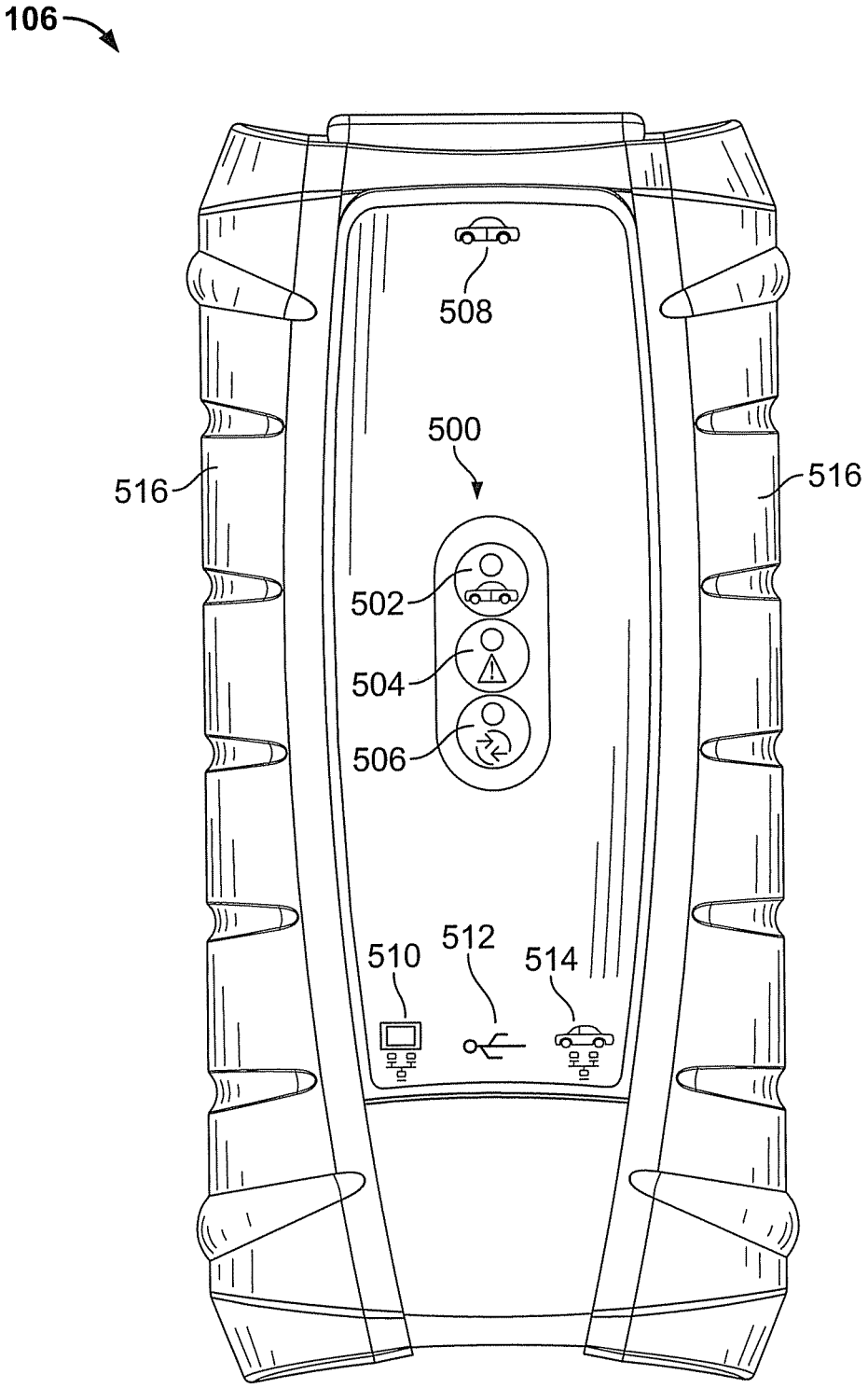
FIG. 5 to FIG. 14 illustrate various views of the example vehicle scanner of FIG. 3.

Next, FIG. 4 is a block diagram of vehicle scanner 106, and FIGS. 4 to 14 illustrate various views and details of embodiments of vehicle scanner 106. As illustrated in FIG. 4, vehicle scanner 106 includes a user interface 400, a wireless transceiver 402, a processor 404, a wired interface 406, and a data storage device 408, all of which may be linked together via a system bus, network, or other connection mechanism 410. User interface 400 is operable to present information to a user of vehicle scanner 106. Elements of user interface 400 are illustrated in FIG. 5.

Wireless transceiver 402 comprises a wireless receiver and transmitter operable to carry out wireless communications with one or more of DAQ 104, display device 108, and/or some other device that is operating within wireless communication range of vehicle scanner 106. As an example, wireless transceiver 402 may comprise a transceiver that is operable to carry out communications via a BT network. As another example, wireless transceiver 402 may comprise a transceiver that is operable to carry out communications via a Wi-Fi network. Other wireless communications protocols could also or alternatively be used, including, for example, WiMAX, Cellular, ZigBee, Wireless USB among others.

Wireless transceiver 402 is not limited to a single wireless transceiver. For example, wireless transceiver 402 may comprise both a BT transceiver and a Wi-Fi transceiver. In accordance with such an example, the BT transceiver may communicate with display device 108 and/or DAQ 104 via a BT network, and the Wi-Fi transceiver may communicate with display device 108 and/or DAQ 104 via a Wi-Fi network.

Wired interface 406 may comprise one or more wire-line ports. As an example, wired interface 406 may include wired ports 800 (illustrated in FIG. 8), 1300 and 1302, port 1304 (all illustrated in FIG. 13), slot 1306 (illustrated in FIG. 14), and port 1102 (illustrated in FIG. 11).

Port 800 may be a vehicle interface port that communicatively connects the vehicle scanner 106 to a vehicle 102 via wired link 112. In that regard, wired link 112 may comprise a vehicle interface cable having two cable ends. A first cable end of the vehicle interface cable may include a connector that is connectable to and removable from port 800. A second cable end of the vehicle interface cable may include a connector that is connectable to and removable from a connector in the vehicle 102. The connector in the vehicle 102 may be arranged according to a particular connector standard, such as Society of Automotive Engineers (SAE) specification J-1962 or some other connector standard.

Ports 1300 and 1302 may comprise respective Ethernet ports. Each Ethernet port may communicatively connect to a first end of a respective Ethernet cable. A second end of a respective Ethernet cable may connect to an Ethernet port directly or indirectly connected to local or wide area network (such as the Internet). Another respective Ethernet cable may connect the vehicle scanner to the display device 108 via a corresponding Ethernet port provided on the display device 108. Ethernet ports 1300 and 1302 may additionally provide a path for upgrading internal program code within the vehicle scanner 106, such as CRPI 412.

Port 1304 may comprise a USB port. The USB port 1304 may communicatively connect to a first end of a USB cable. A second end of the USB cable may connect to a corresponding USB port provided on the display device 108. Alternatively, USB port 1304 may connect the vehicle seamier to a personal digital assistant (PDA) device. In this mode, the PDA may act as a USB master and provide instructions to and receive data from, the vehicle scanner 106. Further, in the event that a mass storage device (such as a flash memory stick) is plugged into the USB port 1304, USB port 1304 may provide data storage in addition to or in place of data storage device 408.

Slot 1306 may be a memory card slot that allows additional storage capacity to be added to the device by insertion of a corresponding memory card, or allows propriety diagnostic programs to be loaded via memory card. Memory card slot 1306 is further illustrated in FIGS. 13 and 14.

Port 1102 may be an expansion circuit board port that allows an expansion board to be attached to the vehicle scanner 106 and provide additional functionality. This port is further illustrated in FIG. 11.

Wired interface 406 may further include a configurable set of switches and circuits in communication with port 800 in order to configure port 800 to communicate with a particular vehicle 102. More specifically, because different makes and models of vehicles utilize different signaling standards on their respective diagnostic port, wired interface 406 must include circuits and switches that allow the single port 800 to interface with a varying set of vehicle diagnostic port standards. For example, under the OBD II standard umbrella, signaling interfaces compliant with SAE J1850 PWM, SAE J1850 VPW, ISO 9141-2, ISO 14230 KWP2000, and ISO 15765 CAN could all potentially be used. Switch information may be stored locally in data storage device 408 that, in response to receiving vehicle information from display device 108, sets the switches and circuits to match the required signaling standard. Alternatively, vehicle scanner 106 may receive circuit and switch instructions via wireless transceiver 402 and/or wired interface 406, from display device 108 or some other device.

Processor 404 may comprise one or more general purpose processors (e.g., INTEL microprocessors) and/or one or more special purpose processors (e.g., digital signal processors). Processor 404 may be configured to execute CRPI 412 that are contained in computer-readable data storage device 408 and which cause the processor 404 to perform the functionality described below.

Data storage device 408 may comprise a computer-readable storage medium readable by processor 404. Data storage device 408 may contain various data including, but not limited to, CRPI 412, vehicle scanner data 414, and vehicle diagnostic data 416. CRPI 412 may comprise program instructions for carrying out any one or more of the vehicle scanner 106 functions herein described.

Vehicle scanner data 414 may include switch settings for configuring wired interface 406 and/or commands/data received from display device 108 for configuring wired interface 406 and/or for communicating with the vehicle 102. Vehicle scanner data 414 may further comprise data received at vehicle scanner 106 during a pairing process carried out between vehicle scanner 106 and the DAQ 104 and/or display device 108. For example, the pairing process between vehicle scanner 106 and display device 108 may include vehicle scanner 106 providing display device 108 with the data associated with vehicle scanner 106 and display device 108 providing vehicle scanner 106 with data associated with display device 108. After carrying out the pairing process, vehicle scanner 106 may use the stored data in establishing the communication link 118 with display device 108. The pairing data is not limited to data associated with one remote device. In that regard, the pairing data may also include data associated with DAQ 104 and other devices not illustrated in the figures.

Vehicle diagnostic data 416 may comprise data received from the vehicle 102, including for example, sensor data or error code data.

Data storage device 408 may comprise permanent internal storage comprised of, for example, magnetic or semiconductor-based memory, and/or may comprise a removable memory device, such as a flash card or USB memory stick, or may comprise a combination of the above. Data storage device 408 may comprise a removable card or stick inserted into one or more of USB port 1304 and/or a memory card inserted into memory card slot 1306. Other types of storage could also be used.

Next, FIG. 5 illustrates a front view of an example embodiment of vehicle scanner 106. As forth in FIG. 5, the front face of vehicle scanner 106 includes visual indicators 500 (including 502, 504, and 506), 508, 510, 512, and 514 and side grips 516. Visual indicators 502, 504, and 506, which may be part of user interface 400 and make up indicators 500, may comprise respective light emitting diodes (LEDs) or some other visual indictor that is operable to convey information to a user. Data storage device 408 may include program instructions executable by processor 404 to turn visual indicators 502, 504, and 506 on and off to reflect a corresponding status of the vehicle scanner 106.

Visual indicator 502 may turn on to indicate that vehicle scanner 106 is receiving electrical power from vehicle 102.

Because vehicle scanner 106 may not include its own power source, it may rely upon vehicle 102 to provide it with operating power via the vehicle connector. If visual indicator 502 fails to light after connecting vehicle scanner 106 to the vehicle 102, a repair technician may know to test and diagnose the vehicle's 102 electrical system. Absent another power source, vehicle scanner 106 may fail to operate.

Visual indicator 504 may turn on and off in a periodic manner so as to flash (g., turn on for 1 second and then turn off for 1 second). In particular, visual indicator 504 may flash in specific sequences so as to identify any of a variety of diagnostic or error codes. The diagnostic codes, for example, could pertain to (i) an error in the vehicle 102, (ii) an error within the vehicle scanner 106, (iii) an error communicating with display device 108, or (iv) an error accessing data store 408 and/or a memory card in memory card slot 1306 to retrieve diagnostic instructions. As an example, visual indicator 502 may flash 3 times, wait, and then flash 2 more times, so as to visually present a diagnostic code of 32, which could imply that a wireless connection with display device 108 has failed.

Visual indicator 506 may turn on to indicate that vehicle scanner 106 is carrying out communications with vehicle 102. More specifically, visual indicator 506 may turn on to indicate that vehicle scanner 106 is presently carrying out communications with at least one electronic control unit (ECU) within the vehicle 102, and visual indicator 1704 may turn off to indicate that vehicle scanner 106 is not presently carrying out communications with at least one ECU within the vehicle 102.

Figure 8:
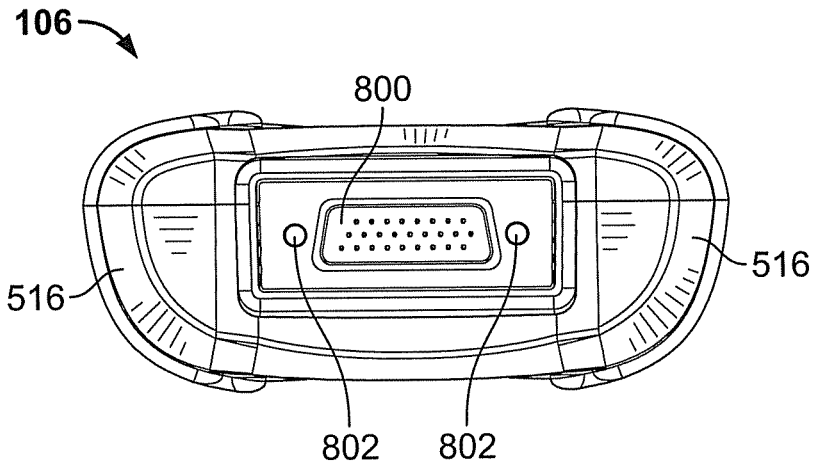

Visual indicator 508 is an orientation indicator, providing an indicator to a repair technician of which side of the vehicle scanner 106 that the vehicle connector port 800 can be found (See FIG. 8).

Figure 13:
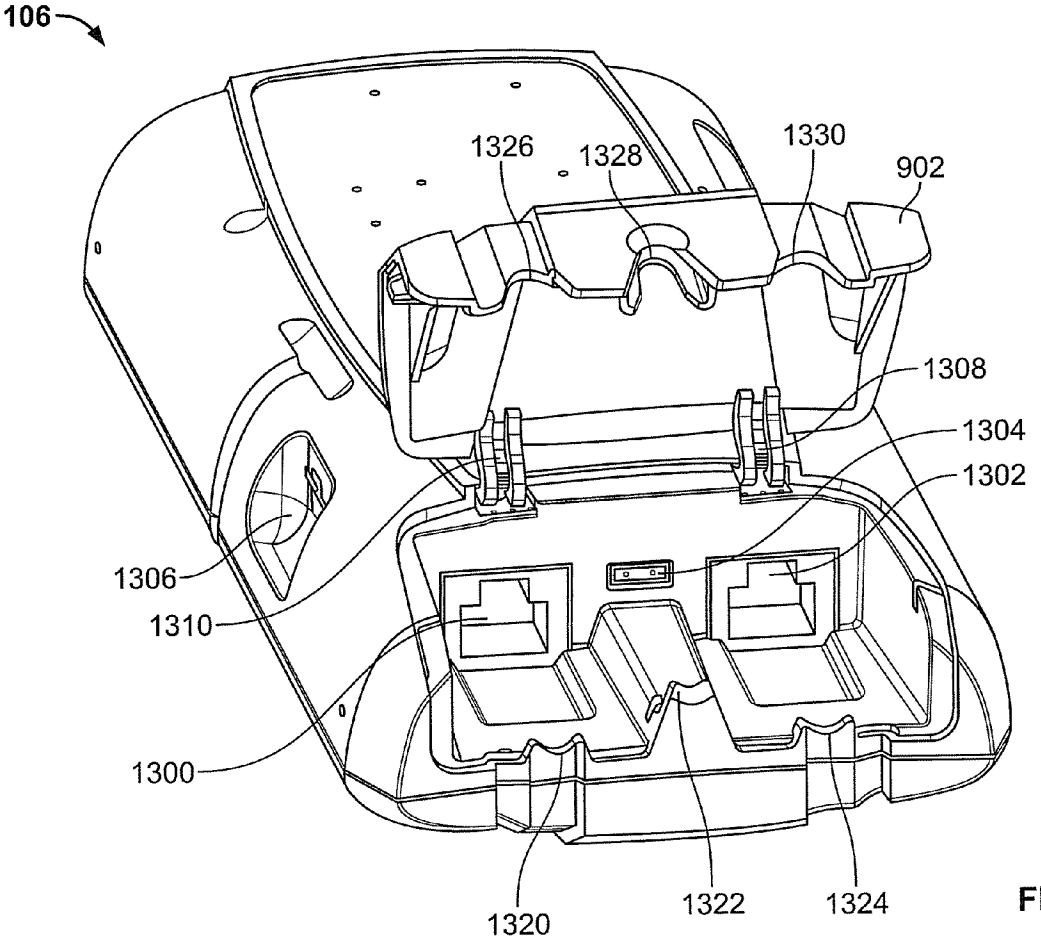

Visual indicators 510 and 514 are communication port activity indicators, and provide an indication of communications activity on the respective Ethernet ports 1300 and 1302 (See FIG. 13). Visual indicators 510 and 514 may flash with a periodic intensity relative to a rate of data being communicated over Ethernet ports 1300 and 1302. Visual indicator 512 is another communication port activity indicator, but instead provides an indication of communications activity on the USB port 1304 (See FIG. 13). Visual indicator 512 may light up when a USB cable is present and properly connects vehicle scanner 106 to another active device, such as display device 108 or a PDA device. Other methods of providing visual indicators are also possible.

Although not shown, any one of the visual indicators noted above could be replaced by an audio indicator. For example, visual indicator 504 could be replaced with a speaker (or with an audio jack for connecting a device that converts electrical signals into audio signals) that emits a continuous or periodic audio tone to indicate a particular diagnostic or error code.

Grips 516 are arranged along the two longitudinal ends of the vehicle scanner, and may function to keep access port cover 902 (See FIGS. 9 and 13) closed and to provide shock absorption in the event that the vehicle scanner is dropped or struck. Grips 516 may be formed as a single piece of rubber connected along a rear or end of the vehicle scanner 106, or may be formed as two separate pieces of rubber. Materials other than rubber could alternatively be used. Grips 516 may have to be removed away from the vehicle scanner to open access port cover 902.

Figure 6:
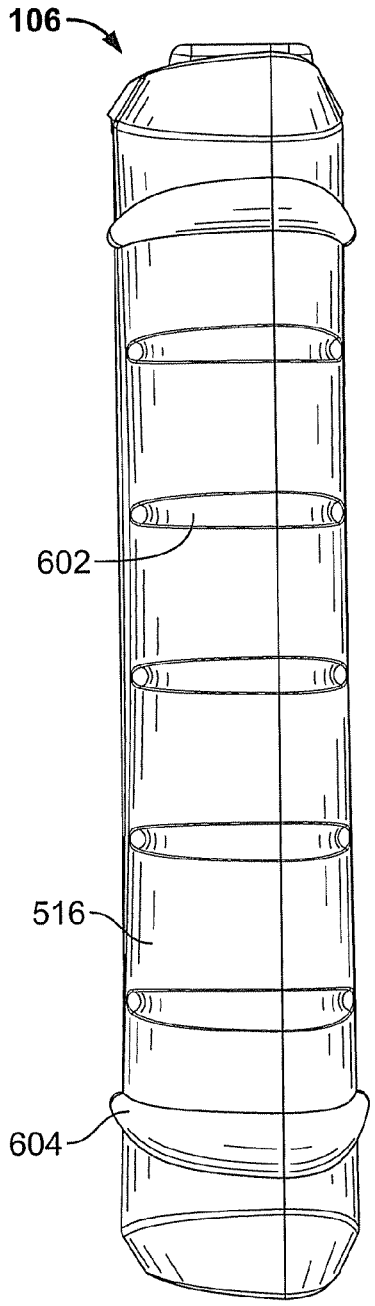
Figure 7:
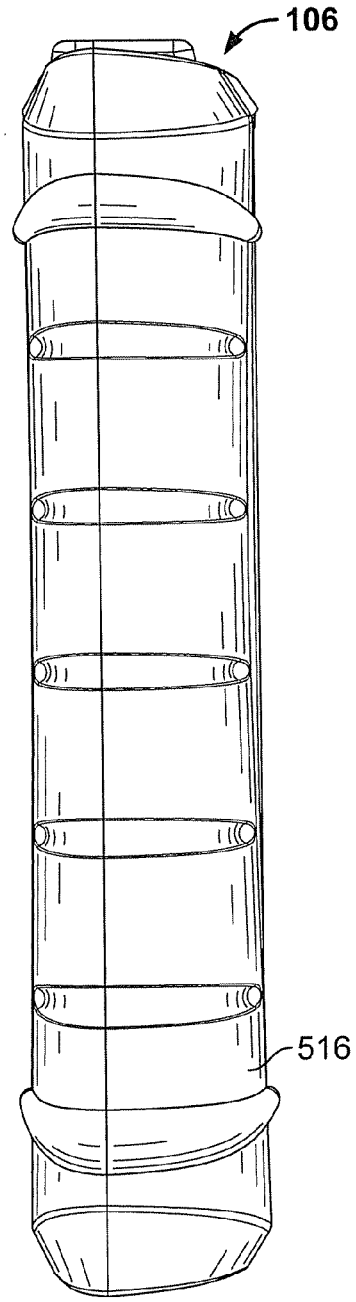

FIGS. 6 and 7 illustrate left-side and right-side views of the example embodiment of vehicle scanner 106. As shown, grips 516 may include concave ribs 602 and convex ribs 604 to improve the ease and comfort of holding the vehicle scanner 106.

Next, FIG. 8 illustrates a top view of the vehicle scanner 106. FIG. 8 further illustrates grips 516, and newly illustrates vehicle interface port 800 and connector mounting holes 802. As an example, port 800 may include a high-density-26 (HD-26) connector, but is not so limited. An HD-26 connector may include 26 male or female connector terminals. Port 800 is arranged to facilitate a wire-line connection to vehicle 102 via wired link 112. Wired link 112 may comprise a cable that includes fasteners that are arranged to fasten one end of the cable to vehicle scanner 106 via connector mounting holes 802. The other end of the cable may include similar fasteners to rigidly secure the cable to the vehicle's 102 diagnostic port.

Figure 9:
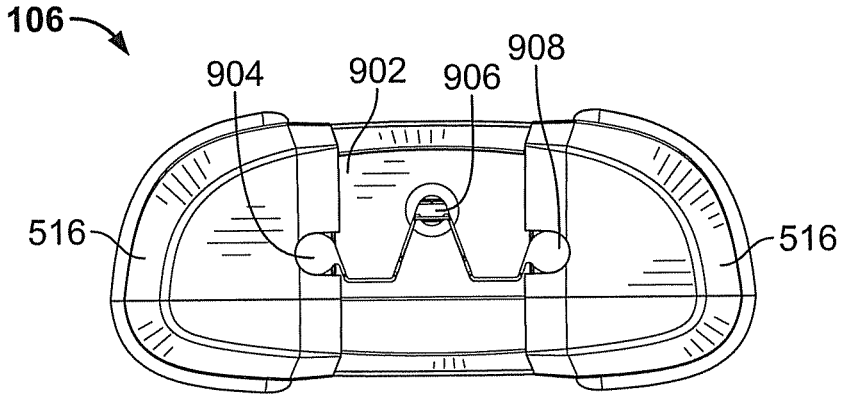

FIG. 9 illustrates a bottom view of the vehicle scanner 106. FIG. 9 further illustrates grips 516 and newly illustrates access port cover 902 and cable openings 904, 906, and 908. Access port cover 902 covers wired-line Ethernet connectors 1300 and 1302, and USB port 1304. Cable openings 904, 906, and 908 allow respective cables connected to ports 1300, 1302, 1304 to extend away from vehicle scanner 106 while allowing the access port cover 902 to remain in a closed position. While in a closed position, access port cover 902 and cable openings 904, 906, 908 serve to prevent advertent pulling of Ethernet or USB cables extending through the openings.

Figure 10:
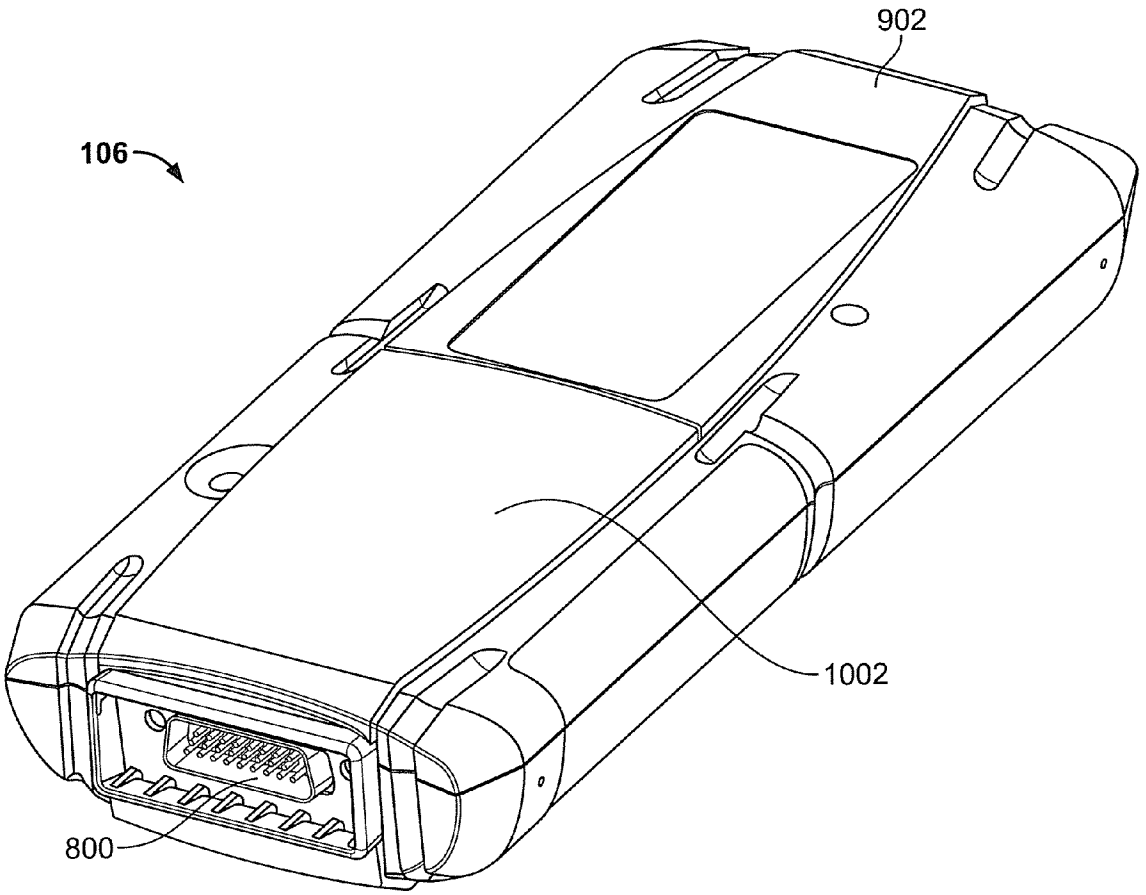
Figure 11:
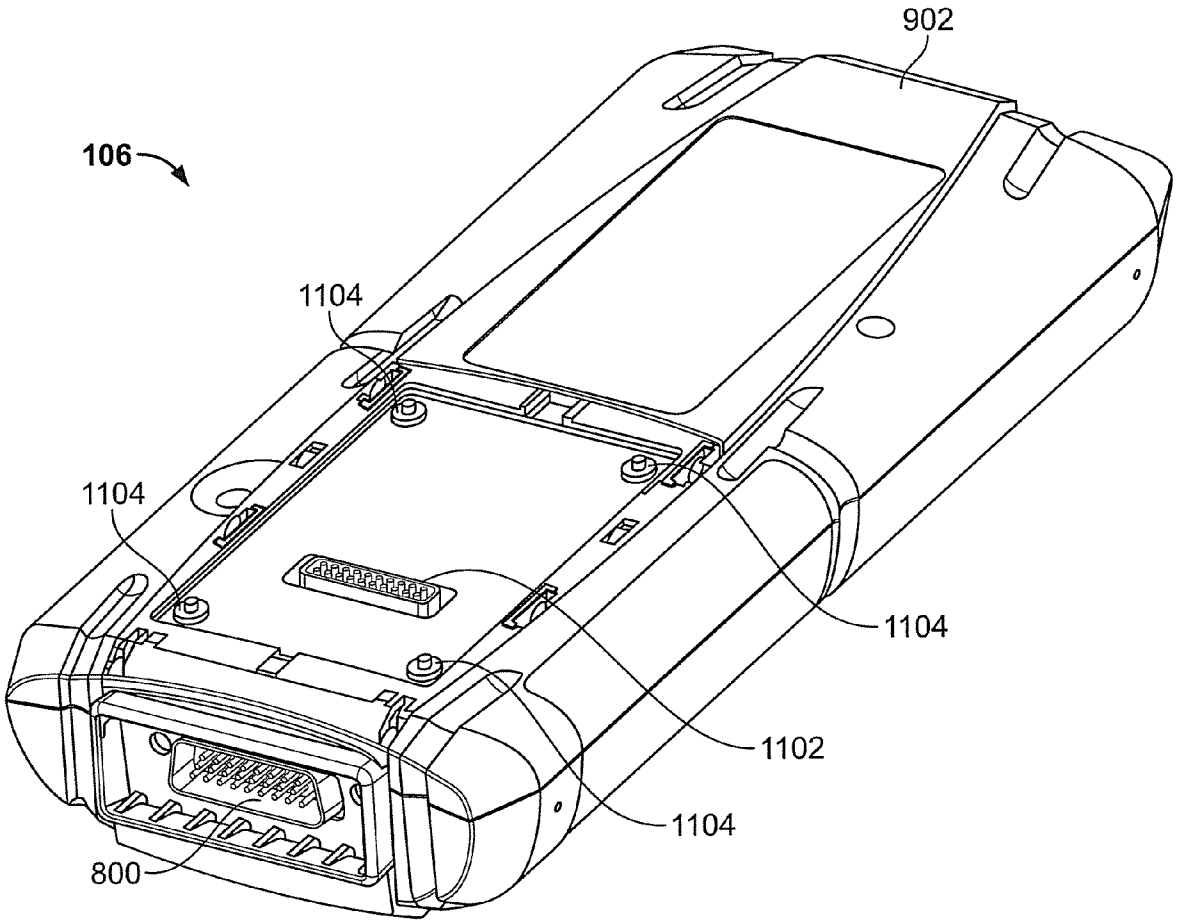
Figure 12:
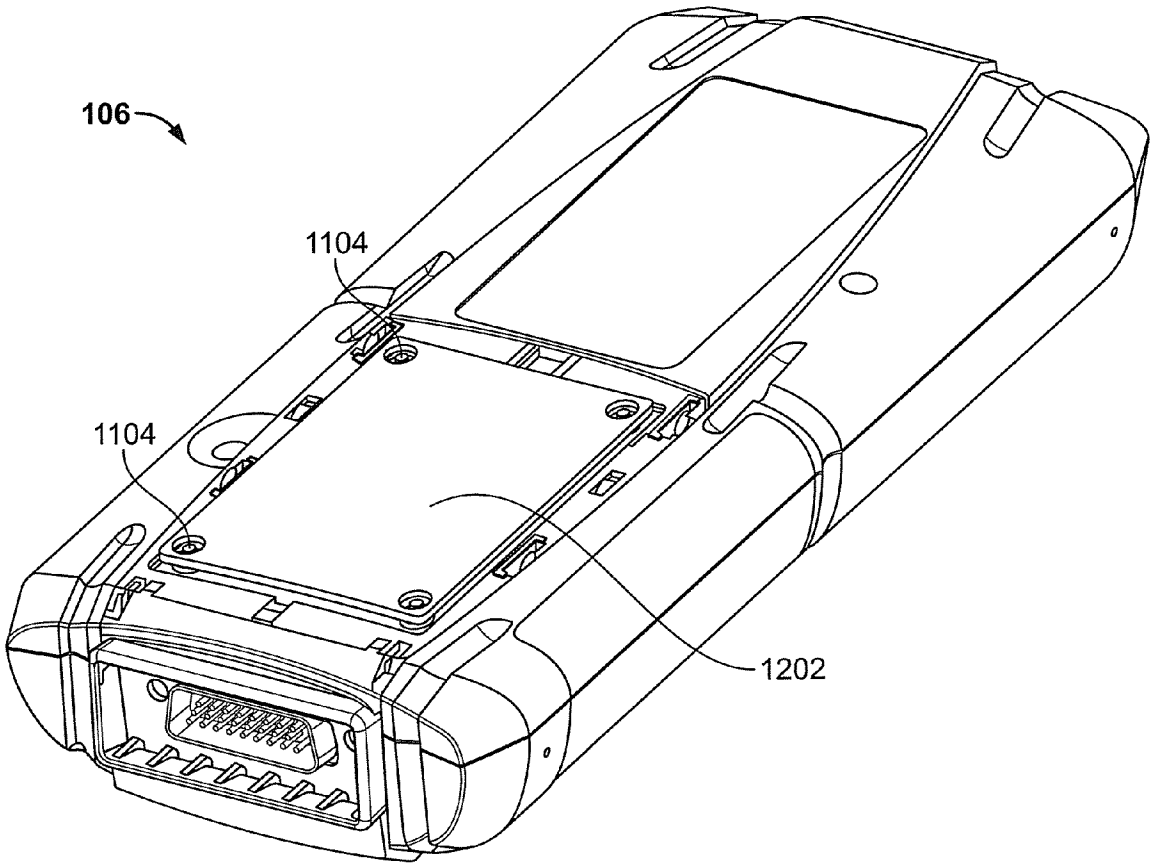

Next, FIG. 10 illustrates vehicle scanner 106 with side grips 516 removed and upper cover 1002 in a closed and secured position. FIG. 11 illustrates vehicle scanner 106 with the upper cover 1002 removed to reveal expansion port 1102 and interface lugs 1104. As shown in FIG. 12, an expansion circuit board 1202 can be secured to the expansion port 1102 and interface lugs 1104. Expansion circuit board 1202 may include a mating port (not shown) that is connectable to expansion port 1102. Expansion circuit board 1202 may comprise, for example, a printed circuit board (PCB) containing a plurality of discrete circuit elements and/or one or more integrated circuits (ICs).

A same or similar upper cover 1002 can then be secured over the expansion circuit board 1202 to enclose the board 1202 and the port 1102. Various expansion circuit boards 1202 can be interfaced with vehicle scanner 106 to provide additional and/or more robust functionality without the need to manufacture an entirely new vehicle scanner 106 device.

FIG. 13 illustrates a vehicle scanner 106 with the access port cover 902 placed in an open position. As shown in FIG. 13, access port cover 902 may be hingedly attached to the vehicle scanner 106 via hinges 1308 and 1310. Hinges 1308 and 1310 are rotatable so as to allow port access cover 902 to move from an open position to a closed position and from the closed position to the open position. Channels 1320, 1322, and 1324 formed in a bottom surface of the vehicle scanner 106 and channels 1326, 1328, and 1330 formed in the access port cover 902 form respective cable openings 904, 906, and 908 when access port cover 902 is in the closed position.

As set forth earlier, while the access port cover 902 is open, access is provided to Ethernet ports 1300 and 1302 and USB port 1304. In alternative embodiments, the ports accessible via access port cover 902 may include a different quantity, or may include different types of ports, including, for example, Firewire or eSATA ports. Vehicle scanner 106 may include a respective cable opening for each port accessible via access port cover 902. Alternatively, one or more cable openings such as openings 904, 906, 908 may allow multiple cables to pass through port access cover 902.

Figure 14:
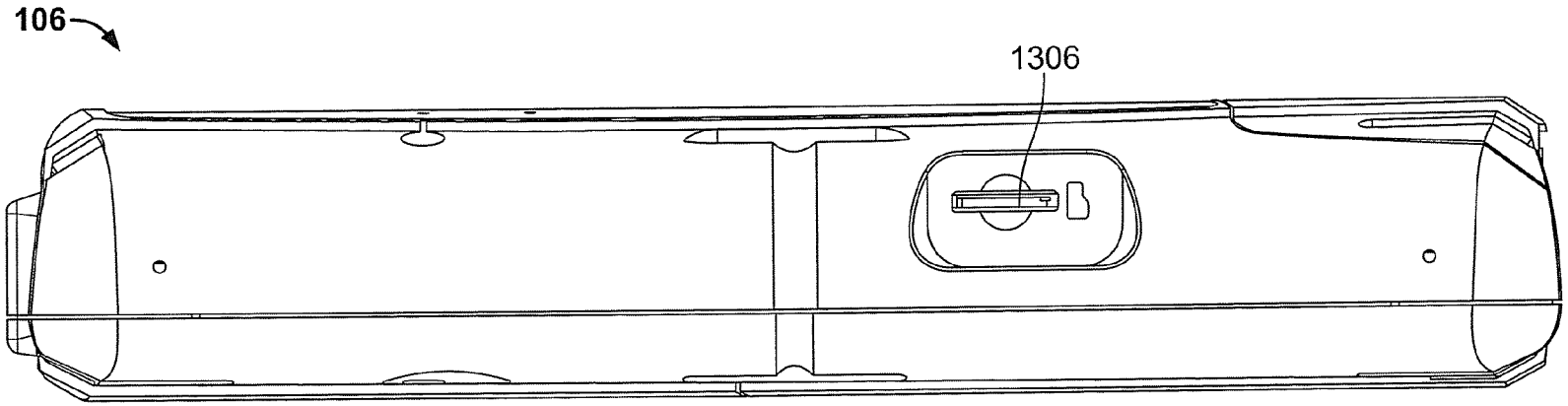
Figure 15:
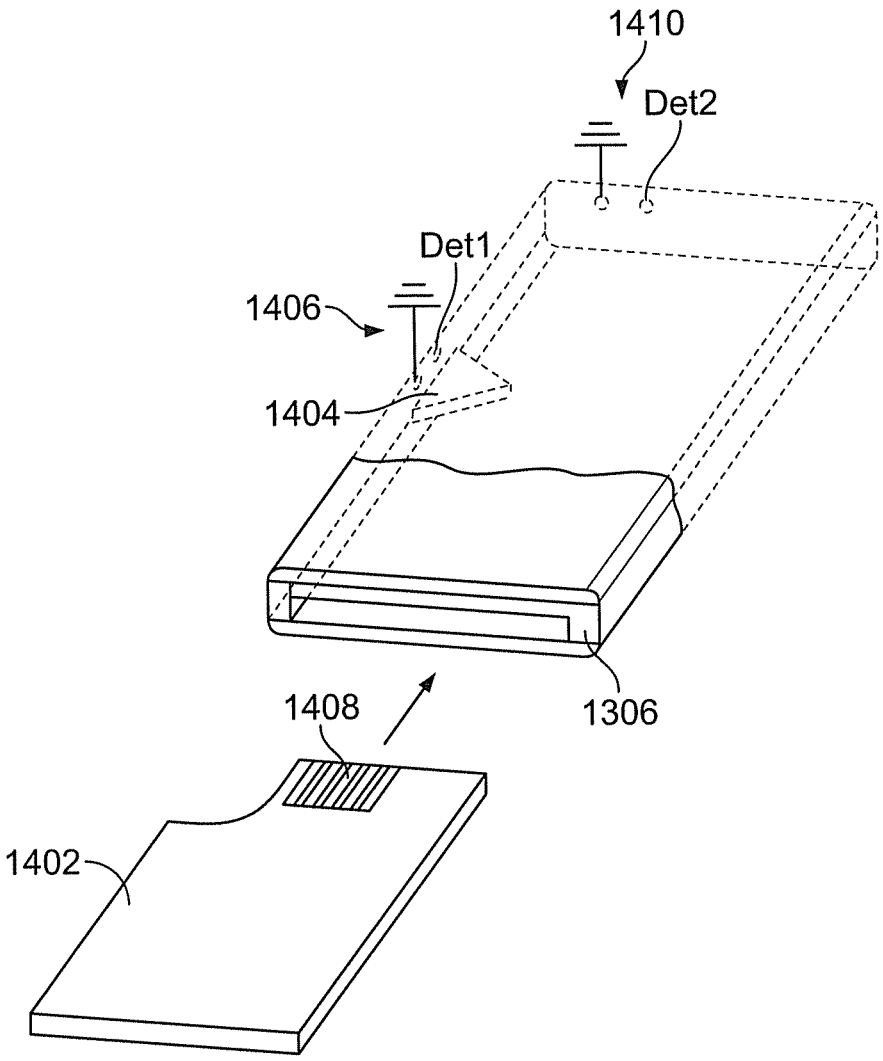
FIG. 15 illustrates a memory card and a cutaway view of a memory card slot.

FIG. 14 illustrates a side view of vehicle scanner 106 and memory slot 1306, and FIG. 15 illustrates memory card 1402 and a cut-away view of memory card slot 1306. Memory card 1402 is shown dimensioned to be insertable in memory card slot 1306. As set forth earlier, memory card slot 1306 may provide the data storage 408 for vehicle scanner 106, or may provide removable data storage separate from and in addition to the data storage 408 provided permanently inside vehicle scanner 106. Memory card 1402 may comprise, for example, a Compact Flash card, an SD memory card, a mini SD memory card, an xD card, or other type of data storage card. Memory card 1402 may further comprise CRPI for execution by processor 404 of the vehicle scanner 106. The removable data storage card may also provide storage space for storage of vehicle diagnostic data 416, either in place of data storage device 408, or in addition to data storage device 408.

Various mechanisms may be provided within memory card slot 1306 for detecting a presence of a memory card 1402 within the slot 1306. For example, a spring-loaded electrically conducting protrusion 1404 could be provided that, when pushed back by the insertion of memory card 1402, completes a circuit 1406 and generates a signal detectable by vehicle scanner 106 that a memory card has been inserted or is present in memory card slot 1306. Alternatively, conductive traces 1408 formed on an upper surface of memory card 1402 could complete a circuit 1410 when memory card 1402 is fully inserted in memory card slot 1306 and generates a signal detectable by vehicle scanner 106 that a memory card has been inserted or is present in memory card slot 1306. Additionally, vehicle scanner 106 may be configured to detect a presence of a memory by attempting to access data stored on memory card 1402 at initial power-on or at intervals thereafter (periodic, intermittent, or otherwise). Other methods of detecting a presence or insertion of memory card 1402 in memory card slot 1306 could also be used. Although not shown in FIG. 14, additional metal pins may be formed at the rear of memory card slot 1306 corresponding to locations of metal pins formed on the memory card 1402 to facilitate the transfer of data between memory card 1402 and processor 404 via bus 410.

II. Example Operation

Figure 16:
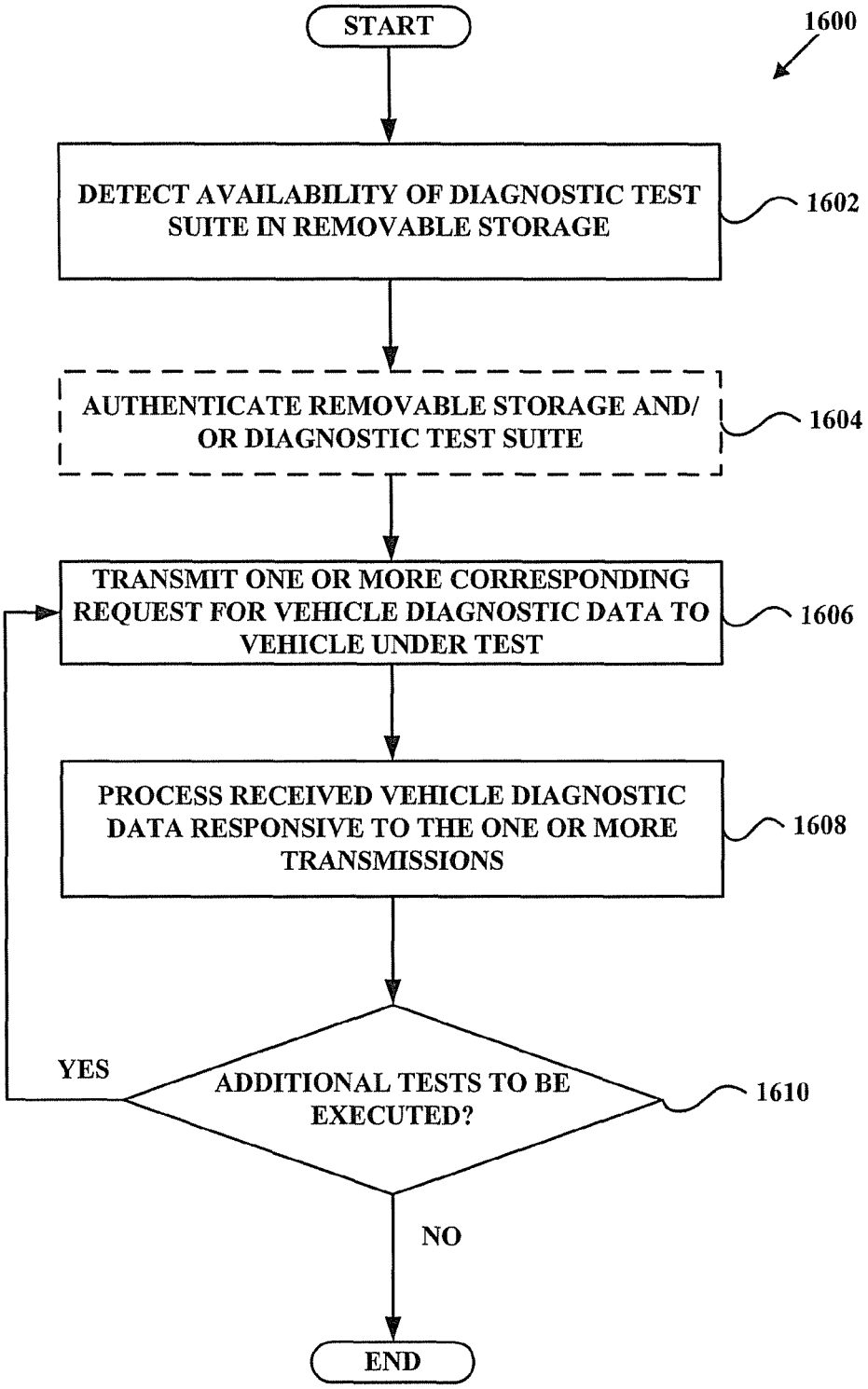
FIG. 16 illustrates a process flow that the vehicle scanner may execute in accordance with an embodiment.

FIG. 16 is a flowchart illustrating an exemplary operation 1600 of vehicle scanner 106. FIG. 16 is exemplary in nature. Accordingly, although FIG. 16 illustrates a number of steps in a particular order, vehicle scanner 106 could execute a subset of the steps set forth in FIG. 16, additional steps not shown in FIG. 16, or the steps of FIG. 16 in an order different than that shown in FIG. 16. The set of functions 1600 may be carried out by processor 404 executing CRPI 412 that together, implement the functions of FIG. 16.

As set forth in step 1602, vehicle scanner 106 first detects an availability of one or more diagnostic requests in a diagnostic test suite in removable storage. Detecting a presence of a diagnostic test suite may be accomplished in a number of ways. For example, vehicle scanner 106 may, responsive to initially receiving operating power from vehicle 102 via vehicle interface vehicle connector port 800, access memory card 1402 via memory card slot 1306 and execute any diagnostic test suites located on the memory card 1402. Test suite data stored on the memory card 1402 may include a flag indicating whether it is intended to be automatically executed upon power-on, and vehicle scanner 106 may only execute the diagnostic requests if it locates such a flag. In another embodiment, vehicle scanner 106 may execute any diagnostic requests it locates regardless of the existence of an execution flag.

Alternatively or additionally, detecting the presence of a diagnostic test suite in removable storage may comprise the vehicle scanner 106, after already being powered-on, receiving a signal from memory card slot 1306 indicating an insertion of a memory card 1402 and, responsive to receiving the signal, automatically accessing the memory card 1402 and executing any diagnostic test suites it locates. In an alternative embodiment, test suite data stored on the memory card 1402 may include a flag indicating whether it is intended to be automatically executed upon insertion, and vehicle scanner 106 may only execute the diagnostic requests if it locates such a flag. In another embodiment, vehicle scanner 106 may execute any diagnostic requests it locates regardless of the existence of an execution flag.

In order to detect insertion of the memory card 1402, one or more mechanical and/or electrical detection mechanisms may be provided in the memory slot 1306 as set forth in FIG. 15 and may generate a signal indicative of a memory card 1402 insertion, as described above. Vehicle scanner 106 may respond to receiving the signal by accessing the memory card 1402 and executing any corresponding diagnostic requests.

As part of the process of detecting an availability of diagnostic test suite at step 1602, or perhaps as a separate optional step 1604, vehicle scanner 106 may authenticate the memory card 1402 and/or the diagnostic test suite located on memory card 1402, prior to executing any diagnostic requests located on the memory card 1402. Authentication may comprise any process intended to prevent execution of unauthorized memory cards 1402 and/or unauthorized diagnostic test suites. For example, the manufacturer of the vehicle scanner 106 may wish to prevent other manufacturers from making and/or selling memory cards 1402 for use on vehicle scanner 106 without authorization or perhaps without passing a certification process to ensure the quality of the memory card 1402 and/or diagnostic test suite.

In one embodiment, memory card 1402 may contain an intentional bad sector at a particular address, and authentication may comprise attempting to access the intentional bad sector and receiving a read error. Alternatively, memory card 1402 may contain a memory address translation circuit that causes a read to a particular address outside of the normal readable address range associated with the size of the memory card to be routed to a second address within the normal readable address range and that contains a value that is matched with a predetermined value stored in the vehicle scanner 106. Of course, additional or alternative methods of authenticating the memory card 1402 and/or diagnostic test suite could be used.

After detecting the availability of a diagnostic test suite in removable storage at step 1602, vehicle scanner 106 reads the diagnostic test requests from the memory card 1402 and transmits one or more corresponding requests for vehicle diagnostic data to the vehicle 102 via bus 410 and vehicle interface port 800. The corresponding requests may be the same vehicle diagnostic requests loaded from the memory card 1402, or may be newly generated based on the vehicle diagnostic requests loaded from the memory card 1402. As part of the transmission process, vehicle scanner 106 may detect and/or be informed of the make/model of the vehicle 102 under test, or may detect and/or be informed of what standard or protocol the vehicle interface (DLC) on the vehicle implements. The switch settings may be included on the memory card 1402 itself, or may be obtained via wireless transceiver 402 or wired interface 404 from display device 108. Other methods of obtaining switch settings and/or make/model of the vehicle 102 under test could also be used. After correctly setting the switch settings, vehicle scanner 106 may transmit the corresponding requests to the vehicle 102 using the proper protocol.

A corresponding request for vehicle diagnostic data in step 1606 may take the form of, for example, a request for the presence of any diagnostic trouble codes (DTCs), which are also known as error codes. Alternatively, the request could take the form of an inquiry regarding whether a particular DTC has been set. Furthermore, particular attributes may be requested to be interrogated or monitored. For example, requests may be generated relating to the engine, the anti-lock braking system (ABS), the transmission, the air bag controller and/or other systems or modules of vehicle 102. A request may seek information about an individual sensor, such as a throttle, revolutions per minute (RPM), or coolant temperature. Additionally, a request may cause a test to be initiated by the ECU in the vehicle 102 and resultant diagnostic information about the test returned to the vehicle scanner 106.

Responsive to transmitting the corresponding requests, and at step 1608, vehicle scanner 106 begins receiving vehicle diagnostic data responsive to the transmissions, and processes the received vehicle diagnostic data. Processing the received diagnostic data may comprise storing the data back to the memory card 1402 in the memory card slot 1306. The memory card 1402 containing the resultant vehicle diagnostic data may then be removed and carried elsewhere for further analysis and/or diagnosis of the vehicle 102. Alternatively or additionally, processing could comprise the vehicle scanner 106 transmitting the vehicle diagnostic data to the display device 108 via the wireless transceiver 402 and/or wired interface 404. Further analysis and/or diagnosis of the problem could then be executed at display device 108. In the event the instructions on the memory card 1402 instruct vehicle scanner 106 to transmit the resultant vehicle diagnostic data to display device 108, but no wired or wireless connection between vehicle scanner 106 and display device 108 is available, vehicle scanner 106 may instead store the resultant vehicle diagnostic data back to the memory card 1402. Other methods of processing the received diagnostic data could also be implemented.

At step 1610, vehicle scanner 106 determines whether any additional tests remain to be executed. As part of the determination, vehicle scanner 106 may access memory card 1402 in the memory card slot 1306 and determine whether any additional diagnostic test requests are to be executed. Whether additional tests are to be executed may depend upon the result(s) of prior tests. If additional requests are to be executed, vehicle scanner 106 returns to step 1506 and begins transmitting additional corresponding requests. If no additional tests are to be executed, vehicle scanner 106 completes method 1500. As part of finishing method 1600, vehicle scanner 106 may automatically power-down. Alternatively or additionally, and in the event vehicle scanner 106 was processing received vehicle diagnostic data by storing the data back to memory card 1402, vehicle scanner 106 may bulk transmit the stored data to display device 108 via one or more of the wireless transceiver 402 and wired interface 406 prior to powering-down, assuming such a connection is or has become available.

In one embodiment of method 1600, for example, memory card 1402 may be a particular memory card 1402 intended to diagnose exhaust problems in a vehicle 102 under test. A repair technician confronted with a suspected exhaust problem may chose a particular memory card 1402 from a selection of memory cards, and insert it into the vehicle scanner 106. Upon insertion of the memory card 1402 or upon powering on, vehicle scanner 106 may detect the availability of a diagnostic test suite on memory card 1402, execute the exhaust-related diagnostic tests from memory card 1402, and transmit corresponding requests to vehicle 102 under test. Vehicle diagnostic data received in response to the requests may be stored back to the memory card 1402, transmitted to display device 108, or transmitted to some other device. In the event that the vehicle diagnostic data has been stored back to memory card 1402, and after all tests have been completed, memory card 1402 may be removed from vehicle scanner 106 and inserted into another device, such as display device 108 for further analysis and report.

Figure 17:
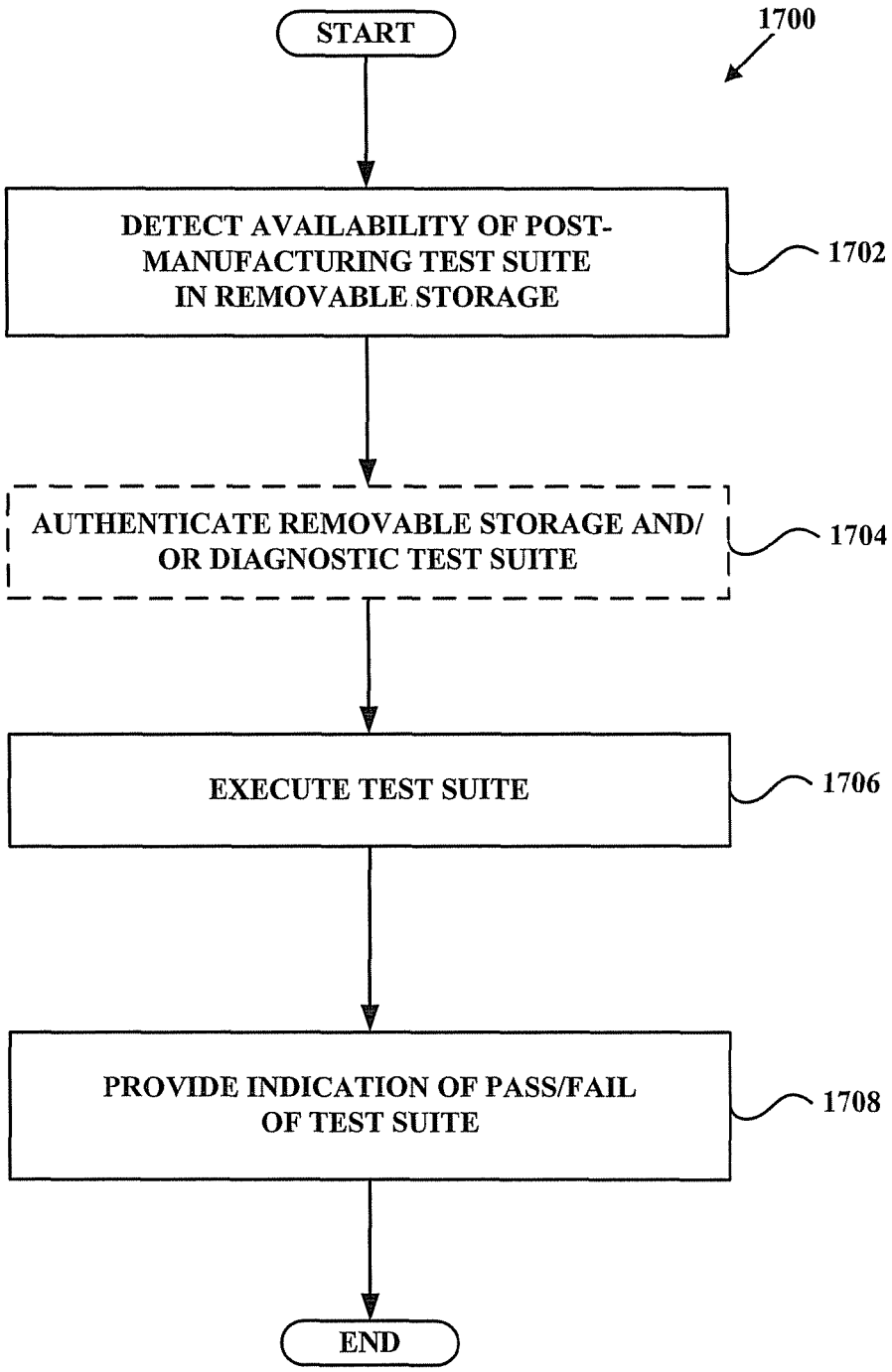
FIG. 17 illustrates a process flow that the vehicle scanner may execute in accordance with another embodiment.

FIG. 17 is a flowchart illustrating another exemplary operation 1700 of vehicle scanner 106. FIG. 17 is exemplary in nature. Accordingly, although FIG. 17 illustrates a number of steps in a particular order, vehicle scanner 106 could execute a subset of the steps set forth in FIG. 17, additional steps not shown in FIG. 17, or the steps of FIG. 17 in an order different than that shown in FIG. 17. The set of functions 1700 may be carried out by processor 404 executing CRPI 412 that, together, implement the functions of FIG. 17.

As set forth in step 1702, vehicle scanner 106 first detects an availability of one or more post-manufacturing test suites in removable storage. Detecting a presence of a post-manufacturing test suite may be accomplished in a number of ways. For example, vehicle scanner 106 may, responsive to receiving operating power for a first time (perhaps via vehicle interface vehicle connector port 800), access memory card 1402 via memory card slot 1306 and execute any test suites located on the memory card 1402. Post-manufacturing test suites stored on the memory card 1402 may include a flag indicating whether it is intended to be automatically executed upon first power-on, and vehicle scanner 106 may only execute the corresponding test suites if it locates such a flag, and then only perhaps if vehicle scanner 106 also determines that this is its first power-on. In another embodiment, vehicle scanner 106 may execute any post-manufacturing test suite it locates regardless of the existence of an execution flag.

Alternatively or additionally, detecting the presence of a post-manufacturing test suite in removable storage may comprise the vehicle scanner 106, after already being powered-on, receiving a signal from memory card slot 1306 indicating an insertion of a memory card 1402 and, responsive to receiving the signal, automatically accessing the memory card 1402 and executing any post-manufacturing test suites it locates.

In order to detect insertion of the memory card 1402, one or more mechanical and/or electrical detection mechanisms may be provided in the memory slot 1306 as set forth in FIG. 15 and may generate a signal indicative of a memory card 1402 insertion, as described above. Vehicle scanner 106 may respond to receiving the signal by accessing the memory card 1402 and executing any corresponding post-manufacturing test suites.

As part of the process of detecting an availability of post-manufacturing test suites at step 1702, or perhaps as a separate optional step 1704, vehicle scanner 106 may authenticate the memory card 1402 and/or the post-manufacturing test suite located on memory card 1402, prior to executing any post-manufacturing test suites on the memory card 1402. Authentication may comprise any process intended to prevent execution of unauthorized memory cards 1402 and/or unauthorized diagnostic test suites, and may comprise any of the methods already discussed above.

After detecting the availability of a post-manufacturing test suite in removable storage at step 1702, vehicle scanner 106 reads the test functions comprising the post-manufacturing test suite from the memory card 1402 and executes one or more corresponding test functions at step 1706. The corresponding test functions may be the same test functions loaded from the memory card 1402, or may be newly generated based on the test functions loaded from the memory card 1402.

Test functions may comprise one or more selected from the group consisting of CPU and register tests, interrupt and exception tests, memory integrity tests, visual indicator/display tests, and input/output interface tests, for example. Other types of tests could also be implemented. A CPU and register test may comprise, for example, shifting pre-determined streams of data through registers contained in the CPU. A result of the shift operations may then be compared to a predetermined 'known good" value in order to determine the proper operation of CPU registers. A memory test may comprise, for example, writing predetermined data to particular memory locations, reading back from the same memory locations at a later time, and comparing the read data to expected data. The memory addresses chosen may be selected so as to test all memory data and address lines, and the storage capability of some or all individual memory locations. Interrupt and exception tests may comprise, for example, creating interrupt and exception conditions and then looping until the expected interrupt is properly recognized. For example, a timer interrupt might be enabled and the test checks a flag that should be set by the vehicle scanner 106 interrupt handler. An input/output interface test may comprise, for example, the attachment of a "loop back" plug on the vehicle interface port 800 that connects output pins on the port 800 to input pins on the port 800, so that data written to output pins can be read back on the input pins and the integrity of the interface 800 verified. Visual indicator tests may comprise, for example, displaying varying visual output patterns via indicators 500. Other methods of testing vehicle scanner 106 may additionally or alternatively be included on memory card 1402.

At step 1708, vehicle scanner 106 provides an indication of pass/fail of the post-manufacturing test suite. The indication may be provided via indicators 500. For example, indicators 502, 504, and 506 may display in a particular lit pattern to indicate that all vehicle scanner 106 circuits passed their respective tests. A different pattern may indicate that one or more circuits failed, and a particular blinking interval may identify the particular failing circuit/device element. Alternatively or additionally, information regarding pass/fail may be stored back to memory card 1402 via memory card slot 1306. In this manner, more in-depth information may be provided, including for example, the test sequence executed and the incorrect result that generated the error. This more detailed infatuation may then be used to more accurately pin down the source of the error. Other methods of reporting results of the execution of the post-manufacturing test suite(s) may also be used.

III. Conclusion

Example embodiments of the present invention have been described above. Those skilled in the art will understand that changes and modifications may be made to the described embodiments without departing from the true scope and spirit of the present invention, which is defined by the claims.

I claim:

1. A vehicle diagnostic device connectable to a diagnostic port of a vehicle, the vehicle diagnostic device comprising:

a processor;

a first data storage device storing computer-readable program instructions;

a removable data storage device storing a test suite including one or more executable diagnostic requests;

a communications interface configured to transmit data to a display device;

a data storage device slot into which the removable data storage device can be inserted, wherein the removable data storage device is removable from the data storage device slot after being inserted into the data storage device slot; and a vehicle interface that is connectable to the diagnostic port of the vehicle;

wherein the processor is configured to execute the program instructions stored on the first data storage device to perform functions comprising:

detecting insertion of the removable data storage device into the data storage device slot, reading, while the removable data storage device is within the data storage device slot, a first executable diagnostic request stored on the removable data storage device, executing, while the removable data storage device is within the data storage device slot, the first executable diagnostic request read from the removable data storage device, wherein execution of the first executable diagnostic request causes the vehicle interface to transmit, to a vehicle diagnostic system within the vehicle via the diagnostic port, a request for vehicle diagnostic data from the vehicle diagnostic system, and processing the vehicle diagnostic data received at the vehicle interface responsive to transmission of the request for vehicle diagnostic data, wherein processing the vehicle diagnostic data comprises routing the vehicle diagnostic data received at the vehicle interface to the communications interface for transmission to the display device.

2. The vehicle diagnostic device of claim 1, wherein processing the vehicle diagnostic data further comprises routing the received vehicle diagnostic data to the removable data storage device.

3. The vehicle diagnostic device of claim 1, wherein the communications interface comprises a wireless communications interface.

4. The vehicle diagnostic device of claim 1, wherein the communications interface comprises a wire-line communications interface.

5. The vehicle diagnostic device of claim 4, wherein the wire-line communications interface comprises a universal serial bus (USB) interface or an Ethernet interface.

6. The vehicle diagnostic device of claim 1, wherein detecting insertion of the removable data storage device into the data storage device slot comprises receiving a signal indicating an insertion of the removable data storage device in the data storage device slot.

7. The vehicle diagnostic device of claim 6, wherein the signal is generated by activation of a mechanical switch upon insertion of the removable data storage device in the data storage device slot.

8. The vehicle diagnostic device of claim 6, wherein the signal is generated by completion of an electrical circuit upon insertion of the removable data storage device in the data storage device slot.

9. The vehicle diagnostic device of claim 1, further comprising:

a spring-loaded electrically conducting protrusion within the data storage device slot, wherein the spring-loaded electrically conducting protrusion is moveable to a position at which the spring-loaded electrically conducting protrusion completes a circuit to allow generation of a signal that indicates the removable data storage device has been inserted into the data storage device slot, and wherein insertion of the removable data storage device into the data storage device slot causes movement of the spring-loaded electrically conducting protrusion to the position.

10. The vehicle diagnostic device of claim 1, further comprising:

an incomplete circuit extending to the data storage device slot, wherein the removable data storage device includes conductive traces to complete the incomplete circuit while the removable data storage device is fully inserted into the data storage device slot, and wherein completion of the incomplete circuit causes generation of a signal that indicates the removable data storage device has been inserted into the data storage device slot.

11. The vehicle diagnostic device of claim 1, wherein the test suite includes a flag that indicates whether the test suite is to be executed automatically, and wherein the processor is configured to execute the program instructions stored on the first data storage device so as to locate the flag prior to executing the first executable diagnostic request.

12. A method of obtaining and processing vehicle diagnostic data, the method comprising:

detecting, by a processor of a vehicle scanner, insertion of a removable data storage device into a data storage device slot of the vehicle scanner, wherein the removable data storage device is removable from the data storage device slot after being inserted into the data storage device slot;

reading, by the processor while the removable data storage device is within the data storage device slot, a first executable diagnostic request stored on the removable data storage device;

executing, while the removable data storage device is within the data storage device slot, the first executable diagnostic request read from the removable data storage device, wherein execution of the first executable diagnostic request causes a vehicle interface of the vehicle scanner to transmit, to a vehicle diagnostic system within a vehicle via a diagnostic port of the vehicle, a request for vehicle diagnostic data from the vehicle diagnostic system; and processing, by the processor, the vehicle diagnostic data received at the vehicle interface responsive to transmission of the request for vehicle diagnostic data, wherein processing the vehicle diagnostic data comprises routing the vehicle diagnostic data received at the vehicle interface to a communications interface of the vehicle scanner for transmission to a display device.

13. The method of claim 12, wherein processing the vehicle diagnostic data further comprises routing the vehicle diagnostic data to the removable data storage device.

14. The method of claim 12, wherein the communications interface comprises a wireless communications interface.

15. The method of claim 12, wherein the communications interface comprises a wire-line communications interface.

16. The method of claim 15, wherein the wire-line communications interface comprises a universal serial bus (USB) interface or an Ethernet interface.

17. The method of claim 11, wherein detecting insertion of the removable data storage device into the data storage device slot comprises receiving a signal indicating an insertion of the removable data storage device in the data storage device slot.

18. The method of claim 17, wherein the signal is generated by activation of a mechanical switch upon insertion of the removable data storage device in the data storage device slot.

19. The method of claim 17, wherein the signal is generated by completion of an electrical circuit upon insertion of the removable data storage device in the data storage device slot.

* * * * *